US009964913B2

(12) United States Patent
Matsuno

(10) Patent No.: US 9,964,913 B2
(45) Date of Patent: May 8, 2018

(54) IMAGE FORMING APPARATUS AND VOLTAGE SUPPLY METHOD

(71) Applicant: KYOCERA Document Solutions Inc., Osaka (JP)

(72) Inventor: Akinori Matsuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/659,057

(22) Filed: Jul. 25, 2017

(65) Prior Publication Data

US 2017/0322509 A1 Nov. 9, 2017

Related U.S. Application Data

(63) Continuation of application No. 15/163,413, filed on May 24, 2016, now Pat. No. 9,746,813.

(30) Foreign Application Priority Data

May 27, 2015 (JP) ..... 2015-107007

(51) Int. Cl.
*G03G 15/16* (2006.01)
*G03G 15/00* (2006.01)
*G03G 21/16* (2006.01)

(52) U.S. Cl.
CPC ..... *G03G 15/80* (2013.01); *G03G 15/1665* (2013.01); *G03G 21/1633* (2013.01); *G03G 21/1652* (2013.01)

(58) Field of Classification Search
CPC ..... G03G 21/1652; G03G 2221/166; G03G 21/1623; G03G 2221/169; G03G 15/80; G03G 21/1867
See application file for complete search history.

(56) References Cited

U.S. PATENT DOCUMENTS 4,912,563 A * 3/1990 Narita ..... H04N 1/00519 358/401
5,561,499 A * 10/1996 Setoriyama ..... G03G 15/80 399/111

(Continued)

FOREIGN PATENT DOCUMENTS

JP 2009-204708 9/2009

*Primary Examiner* — Clayton E Laballe
*Assistant Examiner* — Ruifeng Pu
(74) *Attorney, Agent, or Firm* — Stein IP, LLC

(57) ABSTRACT

An image forming apparatus and a voltage supply method are provided which are capable of fulfilling a stable bias supply to a fittable-and-removable image forming unit and moreover offering improved accessibility to the board. The image forming apparatus includes a lower casing, an image forming unit, a high-voltage board, and a left interconnecting unit. The high-voltage board has a plurality of electric components and output terminals in its upper surface portion above the image forming unit. When a top cover of the lower casing is removed off, the high-voltage board is exposed. The left interconnecting unit is fitted to a side end portion of the high-voltage board and electrically connected to the output terminals of the high-voltage board. The left interconnecting unit supplies a voltage to the image forming unit via a side portion of the high-voltage board.

12 Claims, 19 Drawing Sheets

(56) References Cited

U.S. PATENT DOCUMENTS 5,918,089 A * 6/1999 Malinich ..... G03G 15/80 361/809
2003/0117477 A1 6/2003 Yamanaka ..... 347/129
2004/0131378 A1* 7/2004 Hattori ..... G03G 15/80 399/90
2006/0153587 A1* 7/2006 Omura ..... G03G 15/50 399/89
2006/0160381 A1* 7/2006 Omura ..... G03G 21/1652 439/76.1
2007/0160380 A1 7/2007 Imaizumi et al. ..... 399/90
2007/0207640 A1* 9/2007 Kawasaki ..... B41J 29/02 439/76.2
2008/0279579 A1* 11/2008 Kuruma ..... G03G 21/1867 399/90
2009/0035008 A1* 2/2009 Inukai ..... G03G 15/80 399/88
2009/0214245 A1 8/2009 Ito et al. ..... 399/88
2010/0247198 A1 9/2010 Saiki et al. ..... 399/394
2011/0051377 A1* 3/2011 Fukushima ..... G03G 15/80 361/748
2011/0299258 A1* 12/2011 Ishii ..... B41J 29/02 361/752
2012/0038937 A1* 2/2012 Son ..... G03G 15/80 358/1.1
2012/0099884 A1* 4/2012 Nakaie ..... G03G 15/5062 399/74
2012/0183325 A1* 7/2012 Sato ..... G03G 15/0194 399/110
2012/0250357 A1* 10/2012 Yokoya ..... H02M 1/4225 363/16
2013/0022367 A1* 1/2013 Choi ..... G03G 21/1867 399/90
2013/0077986 A1* 3/2013 Mori ..... G03G 21/1633 399/90
2014/0055016 A1* 2/2014 Nishikawa ..... H05K 5/0247 312/223.6
2014/0064745 A1* 3/2014 Mashiki ..... G03G 15/80 399/9
2014/0086611 A1* 3/2014 Nakagawa ..... G03G 15/80 399/88
2014/0320885 A1* 10/2014 Kubo ..... G06K 15/4055 358/1.14
2015/0205246 A1* 7/2015 Kato ..... G03G 15/80 399/88
2015/0212477 A1* 7/2015 Ishidate ..... G03G 15/80 347/118
2015/0295336 A1* 10/2015 Cole ..... H01R 12/71 439/81
2016/0187834 A1* 6/2016 Matsuno ..... G03G 21/1619 399/88
2016/0202655 A1* 7/2016 Nakajima ..... G03G 15/80 399/90
2016/0209806 A1* 7/2016 Shiomi ..... G03G 21/206
2016/0349693 A1* 12/2016 Matsuno ..... G03G 15/1665
2017/0023902 A1* 1/2017 Uchida ..... G03G 15/80

* cited by examiner

IMAGE FORMING APPARATUS AND VOLTAGE SUPPLY METHOD

INCORPORATION BY REFERENCE

This application is a continuation of U.S. patent application Ser. No. 15/163,413, filed May 24, 2016, which is based upon and claims the benefit of priority from the corresponding Japanese Patent Application No. 2015-107007 filed on May 27, 2015, the entire contents of which are incorporated herein by reference.

BACKGROUND

This disclosure relates to an image forming apparatus for forming images on sheets.

A typical image forming apparatus for forming images on sheets includes a sheet feed part, an image forming part, and a sheet discharge part. On a sheet fed out from the sheet feed part, an image is formed in the image forming part. Thereafter, the sheet is subjected to image fixing process and then discharged to the sheet discharge part.

In typical image forming apparatuses, a process cartridge (image forming unit) forming the image forming part is fittable and removable to a casing of the image forming apparatus. There is also known a technique that a high-voltage board for supplying high voltage to the process cartridge is placed at a side portion or lower portion of the casing of the image forming apparatus.

With such techniques as described above, contact failures are likely to occur in high-voltage supply paths due to fitting and removal of the image forming unit. Also, with the high-voltage board placed at a side portion or lower portion of the casing of the image forming apparatus, there would be a problem that maintainability of the high-voltage board may deteriorate.

SUMMARY

An image forming apparatus according to one aspect of the disclosure includes an apparatus body, an image forming unit, a transfer part, an electric board, and a voltage supply unit. The apparatus body has a fittable-and-removable top plate. The image forming unit is made fittable and removable to the apparatus body along a specified fitting direction and forms a developer image. The transfer part transfers the developer image onto a sheet. The electric board is placed in the apparatus body so as to extend in the fitting direction above the image forming unit and has a plurality of electric components and an output terminal in its upper surface portion to generate a voltage to be supplied to the image forming unit, the electric board being to be exposed outside the apparatus body when the top plate is removed from the apparatus body. The voltage supply unit is fitted to a side end portion of the electric board extending in the fitting direction and electrically connected to the output terminal to supply the voltage to the image forming unit via a side portion of the electric board.

This disclosure may be a voltage supply method for the image forming apparatus having the above-described constitution.

DETAILED DESCRIPTION

Hereinbelow, an image forming apparatus 1 according to an embodiment of this disclosure will be described in detail with reference to the accompanying drawings. In this embodiment, a tandem type color printer is taken as an example of the image forming apparatus. The image forming apparatus may be, for example, a copier, a facsimile device, a multifunctional peripheral of these and other functions, or the like.

Figure 1:
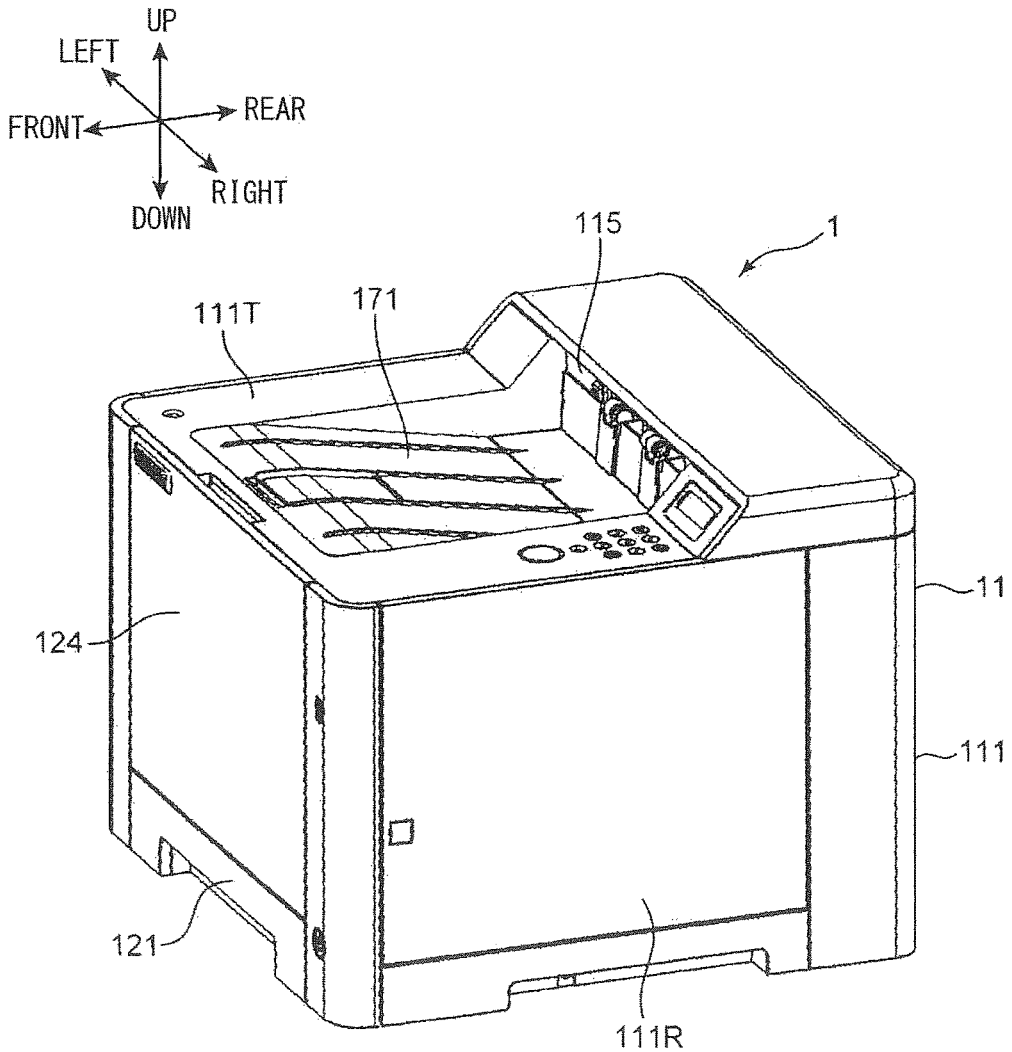
FIG. 1 is a perspective view of an image forming apparatus according to an embodiment of this disclosure.
Figure 2:
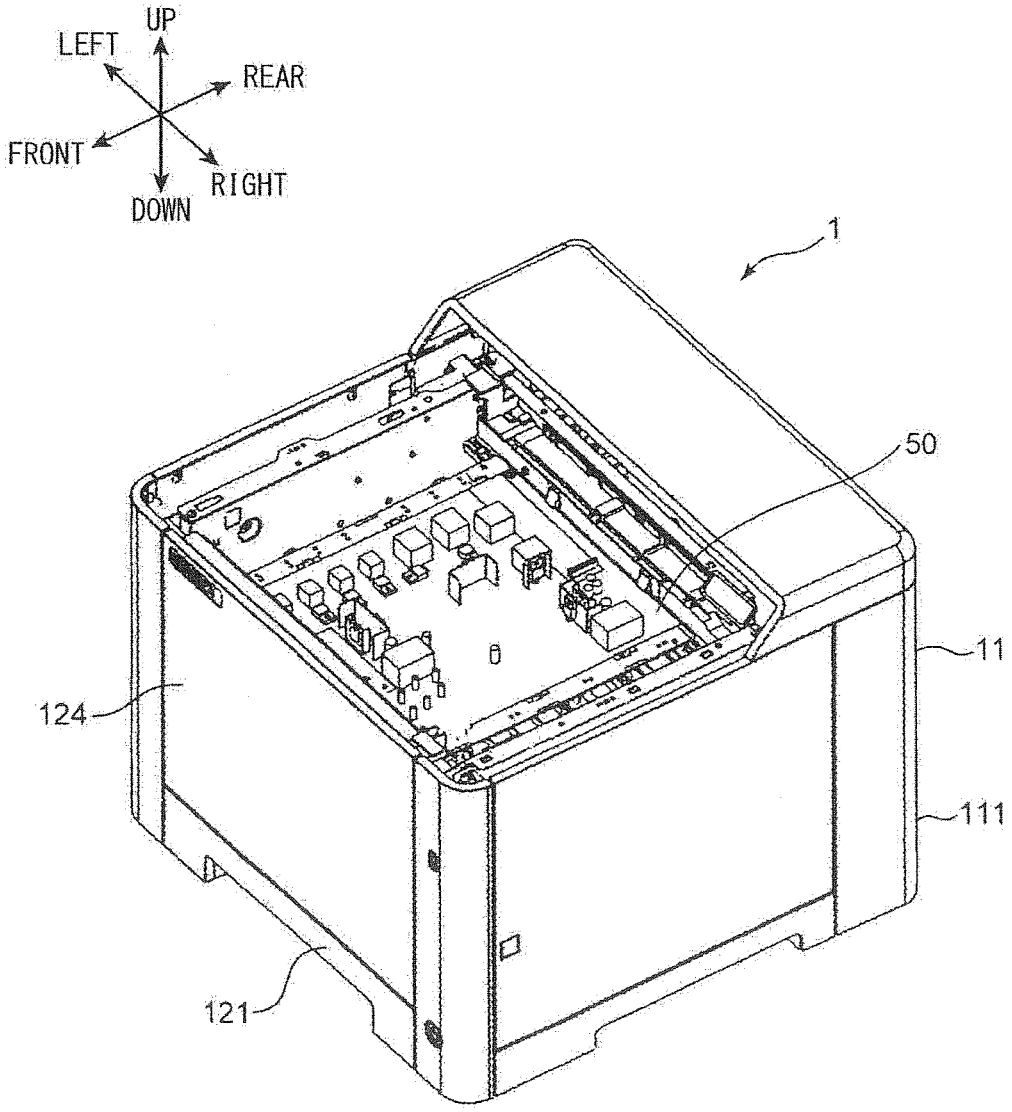
FIG. 2 is a perspective view showing an aspect in which a top plate has been removed in the image forming apparatus according to the embodiment of the disclosure.
Figure 3:
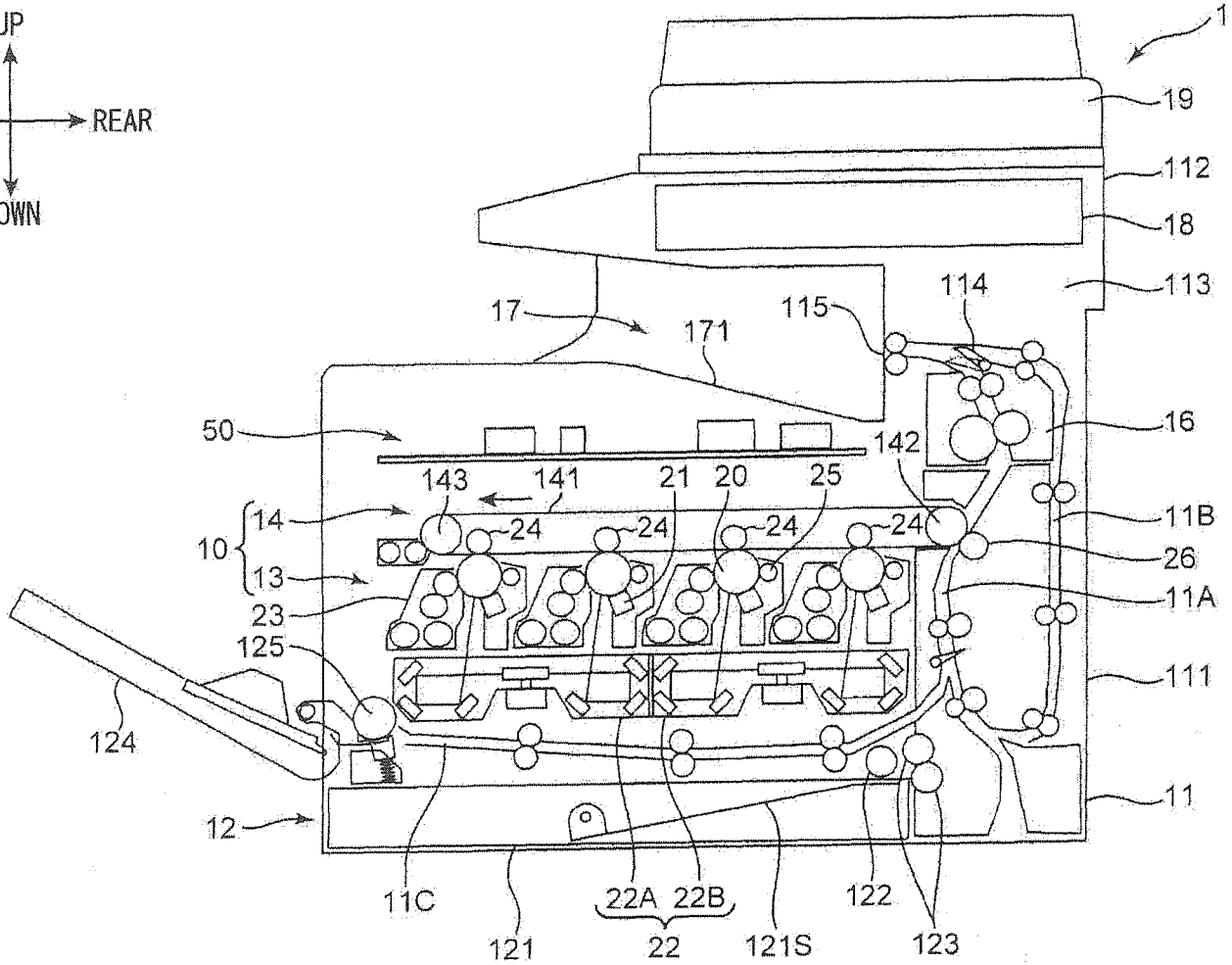
FIG. 3 is a sectional view showing an internal structure of the image forming apparatus according to the embodiment of the disclosure.
Figure 4:
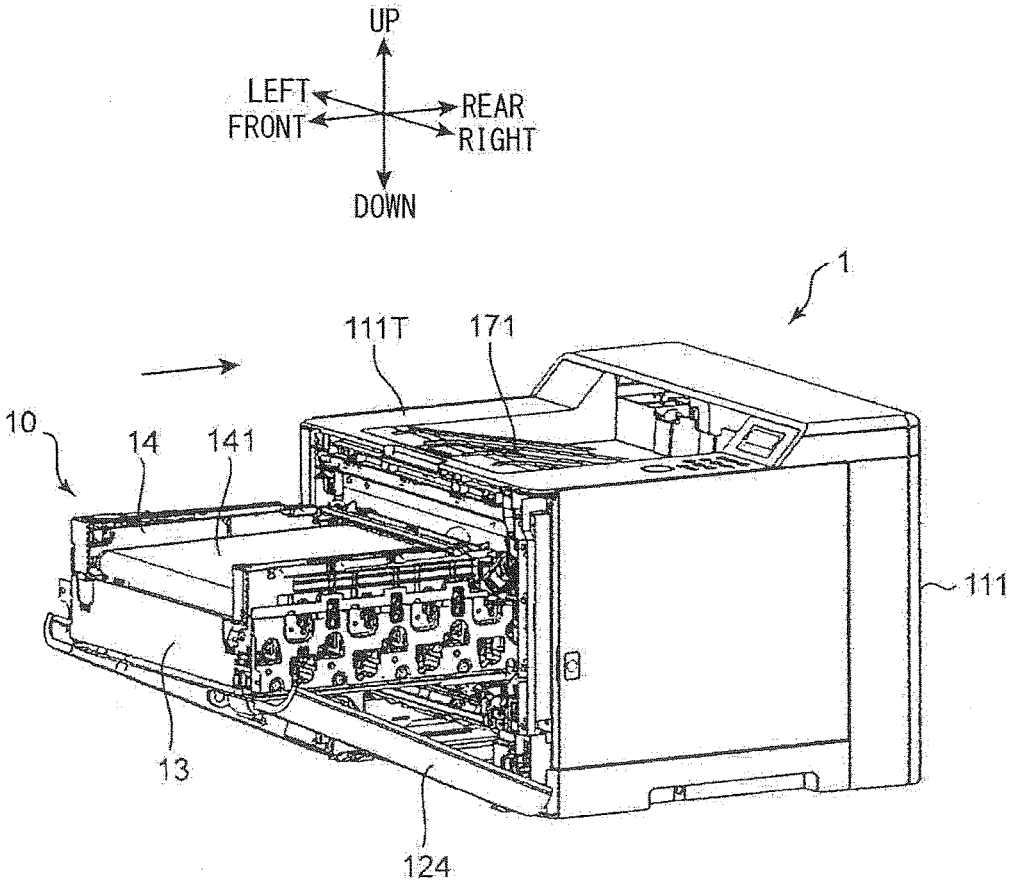
FIG. 4 is a perspective view showing an aspect in which the image forming unit is fitted to the image forming apparatus according to the embodiment of the disclosure.

FIG. 1 is a perspective view of the image forming apparatus 1 according to this embodiment. FIG. 2 is a perspective view showing an aspect in which a top cover 111T (top plate) has been removed in the image forming apparatus 1. FIG. 3 is a sectional view showing an internal structure of the image forming apparatus 1. FIG. 4 is a perspective view showing an aspect in which an image forming unit 10 is fitted to the image forming apparatus 1.

The image forming apparatus 1 includes a box-shaped casing 11. The casing 11 includes a lower casing 111 (apparatus body), an upper casing 112, and a coupling casing 113. It is noted that the upper casing 112 and the coupling casing 113 are omitted for depiction in FIGS. 1, 2 and 4. The lower casing 111, which defines a lower portion of the casing 11, is formed into a generally rectangular parallelepiped shape. The lower casing 111 includes the top cover 111T (top plate). The upper casing 112 is a flat-shaped casing placed above the lower casing 111 with a distance therebetween. The coupling casing 113 couples the lower casing 111 and the upper casing 112 to each other in an up/down direction at their left end portions and rear end portions. A sheet discharge part 17 is formed forward of the coupling casing 113 and between the lower casing 111 and the upper casing 112 (FIG. 3). Sheets with images formed thereon are discharged to the sheet discharge part 17.

The top cover 111T, which is a plate-like member forming part of an upper surface portion of the lower casing 111, is fittable to and removable from the lower casing 111. As the top cover 111T is removed from the lower casing 111, inside of the lower casing 111 is exposed as shown in FIG. 2. In this state, a later-described high-voltage board 50 is exposed outside the lower casing 111. Also, the top cover 111T includes a sheet discharge tray 171 (sheet discharge part). The sheet discharge tray 171 is formed by the top cover 111T partly sinking downward. Sheets with images formed thereon are stacked on the sheet discharge tray 171. The sheet discharge tray 171 has a forward-declined sloped surface which declines from downstream toward upstream side of a discharge direction for sheets with images formed thereon (FIGS. 1 and 3).

Referring to FIG. 3, as conveyance paths along which sheets are conveyed, a main conveyance path 11A, a double-side conveyance path 11B, and a manual-feed conveyance path 11C are provided so as to extend inside the lower casing 111. The main conveyance path 11A serves for conveyance of a sheet from a later-described sheet feed part 12, through a secondary-transfer nip portion between an intermediate transfer unit 14 and a secondary transfer roller 26 as well as a fixing part 16, up to an upper portion of the lower casing 111. As shown in FIG. 3, a plurality of conveyance roller pairs are placed on the main conveyance path 11A.

A switching part 114 and a sheet discharge port 115 (FIGS. 1 and 3) are formed in an upper end portion of the lower casing 111. The switching part 114 serves for switching of the sheet conveyance direction. A sheet conveyed along the main conveyance path 11A is discharged through the sheet discharge port 115 to the sheet discharge part 17. The double-side conveyance path 11B is communicated with a downstream-side end portion of the main conveyance path 11A. The double-side conveyance path 11B is a conveyance path along which a sheet is to be conveyed when an image is formed also on the rear side of the sheet. While a forward end portion of a sheet with an image formed on its front side is exposed from the sheet discharge port 115 to the sheet discharge part 17, the switching part 114 is turned over so that the sheet conveyance path is switched over. Thereafter, as an unshown pair of conveyance rollers are rotated reverse, the sheet is carried into the double-side conveyance path 11B. The sheet, having been conveyed up along the double-side conveyance path 11B, is carried again into the main conveyance path 11A on the upstream side of the secondary-transfer nip portion. As a result, an image is formed on the back side of the sheet. The manual-feed conveyance path 11C is a conveyance path by which a sheet conveyed from the later-described manual feed tray 124 is carried into the main conveyance path 11A. The manual-feed conveyance path 11C is provided so as to extend horizontally above a sheet feed cassette 121.

The image forming apparatus 1 includes a sheet feed part 12, an image forming part 13, an intermediate transfer unit 14, a secondary transfer roller 26 (transfer part), a fixing part 16, a reading part 18, an automatic document feeder 19, and a high-voltage board 50 (electric board).

The sheet feed part 12 is placed in the lower casing 111 to feed sheets. The sheet feed part 12 includes a sheet feed cassette 121, a pickup roller 122, a sheet feed roller pair 123, a manual feed tray 124, and a manual-feed sheet feed roller 125.

The sheet feed cassette 121 is fitted at a lower position of the lower casing 111 so as to be insertable and removable from forward thereof, serving for storing a bundle of sheets, i.e., a stack of plural sheets. The sheet feed cassette 121 has a lift plate 121S inside. The lift plate 121S has a rear end side to be moved upward by an unshown up/down mechanism. As a result of this, sheets stacked on the lift plate 121S are put into contact with the pickup roller 122. The pickup roller 122 rolls out sheets stored on the sheet feed cassette 121. The sheet feed roller pair 123 feeds out the sheets rolled out by the pickup roller 122 to the main conveyance path 11A while loosening those sheets one by one. The manual feed tray 124, which is a tray on which a manually fed sheet is to be set, is released from a front side face of the lower casing 111 as shown in FIG. 3 when manual sheet feed is executed. The manual-feed sheet feed roller 125 rolls out the sheet set on the manual feed tray 124 onto the manual-feed conveyance path 11C.

The image forming part 13, serving for forming toner images (developer images) to be transferred onto a sheet, includes a plurality of units for forming toner images of different colors. Provided as these units in this embodiment are a magenta unit for use of magenta (M)-colored developer, a cyan unit for use of cyan (C)-colored developer, a yellow unit for use of yellow (Y)-colored developer, and a black unit for use of black (BK)-colored developer, where these units are disposed successively from upstream toward downstream side of a rotational direction of the later-described intermediate transfer belt 141 (from front toward rear side in FIG. 3). Each of the units includes a photoconductor drum 20, as well as a charging device 21, a developing device 23 and a cleaning device 25 placed around the photoconductor drum 20. Also, an exposure device 22 for exposing to light the photoconductor drum 20 of the unit is placed under the image forming part 13. The exposure device 22 includes a first exposure unit 22A and a second exposure unit 22B. The first exposure unit 22A applies laser light responsive to image information to around circumferential surfaces of the photoconductor drums 20 of the magenta unit and the cyan unit. The second exposure unit 22B applies laser light responsive to image information to around circumferential surfaces of the photoconductor drums 20 of the yellow unit and the black unit.

Each photoconductor drum 20 is driven into rotation about its axis, by which an electrostatic latent image and a toner image are formed on its circumferential surface. This photoconductor drum 20 may be a photoconductor drum formed with use of an amorphous silicon (a-Si)-based material. The photoconductor drums 20 are placed in correspondence to the individual color units, respectively, as shown in FIG. 3. The charging device 21 electrically charges the surface of the photoconductor drum 20 uniformly. The charging device 21 may be a charging device of the contact charging method which includes a charging roller and a charge cleaning brush for eliminating toner sticking to the charging roller. Also, the cleaning device 25 cleans the circumferential surface of the photoconductor drum 20 after the transfer of a toner image.

The developing device 23 feeds toner to the circumferential surface of the photoconductor drum 20 in order to develop an electrostatic latent image formed on the photoconductor drum 20. The developing device 23, which is for use with two-component developer composed of toner and carrier, includes two stirring rollers, a magnetic roller, and a developing roller. The stirring rollers circulatorily convey the two-component developer, while stirring the developer, to electrically charge the toner. A two-component developer layer is carried on the circumferential surface of the magnetic roller, and a toner layer formed by delivery of the toner based on voltage differences between the magnetic roller and the developing roller is carried on the circumferential surface of the developing roller. The toner on the developing roller is fed to the circumferential surface of the photoconductor drum 20, by which the electrostatic latent image is developed.

The intermediate transfer unit 14 is placed on upside of the image forming part 13. Referring to FIG. 3, the intermediate transfer unit 14 includes an intermediate transfer belt 141, a driving roller 142, a driven roller 143, and a plurality of primary transfer rollers 24.

The intermediate transfer belt 141, which is an endless belt type rotating member, is stretched over between the driving roller 142 and the driven roller 143 so that its peripheral surface side is set in contact with the individual photoconductor drums 20. The intermediate transfer belt 141 is driven into a circulatory rotation of one direction (arrow direction of FIG. 3), by which a toner image transferred from the photoconductor drum 20 is carried on the surface. The intermediate transfer belt 141 is an electroconductive soft belt having a multilayer structure composed of base layer, elastic layer and coat layer.

The driving roller 142 has the intermediate transfer belt 141 stretched thereon at a rear end side of the intermediate transfer unit 14, allowing the intermediate transfer belt 141 to be driven into circulatory rotation. The driven roller 143 has the intermediate transfer belt 141 stretched thereon at a front end side of the intermediate transfer unit 14. The driven roller 143 imparts tensile force to the intermediate transfer belt 141.

Each primary transfer roller 24 primarily transfers the toner image formed on the photoconductor drum 20 onto the intermediate transfer belt 141. As shown in FIG. 3, primary transfer rollers 24 are placed in opposition to the photoconductor drums 20 of individual colors, respectively. As a result of this, primary-transfer nip portions for individual colors are formed between the photoconductor drums 20 and the primary transfer rollers 24, respectively, with the intermediate transfer belt 141 pinched therebetween.

In this embodiment, the image forming part 13 and the intermediate transfer unit 14 are fittable to and removable from the lower casing 111 integrally as the image forming unit 10. In particular, the image forming unit 10 is fitted to the lower casing 111 along the backward direction (fitting direction) as shown in FIG. 4.

The secondary transfer roller 26 (transfer part) is placed in opposition to the driving roller 142 with the intermediate transfer belt 141 pinched therebetween. The secondary transfer roller 26 is set into pressure contact with the peripheral surface of the intermediate transfer belt 141 to form the secondary-transfer nip portion. The secondary transfer roller 26 transfers the toner image from the intermediate transfer belt 141 onto the sheet fed from the sheet feed part 12.

The fixing part 16 includes a fixing roller with a heating source included inside, and a pressure roller placed in opposition to the fixing roller to form a fixing nip portion. The sheet fed to the fixing part 16 is heated and pressured while passing through the fixing nip portion. As a result, the toner image transferred onto the sheet in the secondary-transfer nip portion is fixed on the sheet.

The reading part 18 is placed inside the upper casing 112. The reading part 18 reads an image of a document sheet fed out by the automatic document feeder 19 or a document sheet set on an unshown contact glass. The automatic document feeder 19 conveys a document sheet toward a reading position formed on the contact glass.

Figure 5:
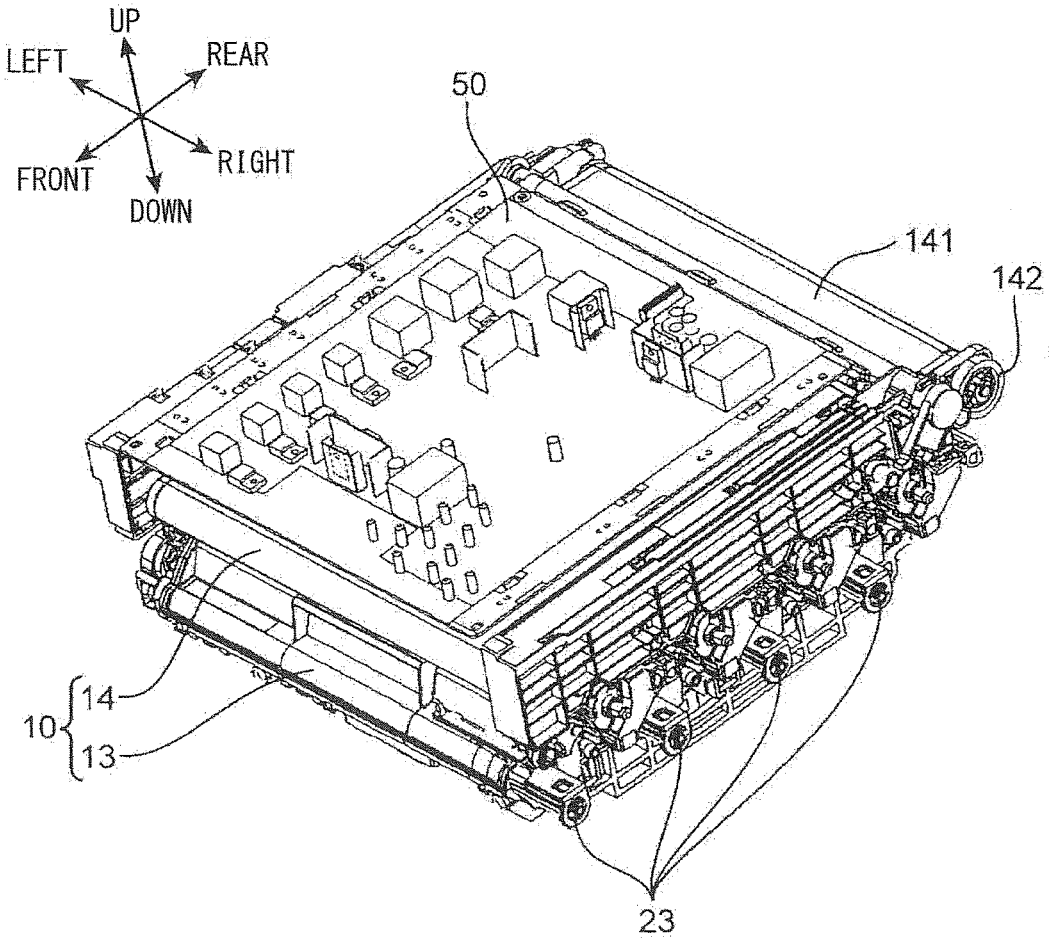
FIG. 5 is a perspective view of the electric board and the image forming unit inside the image forming apparatus according to the embodiment of the disclosure.
Figure 6:
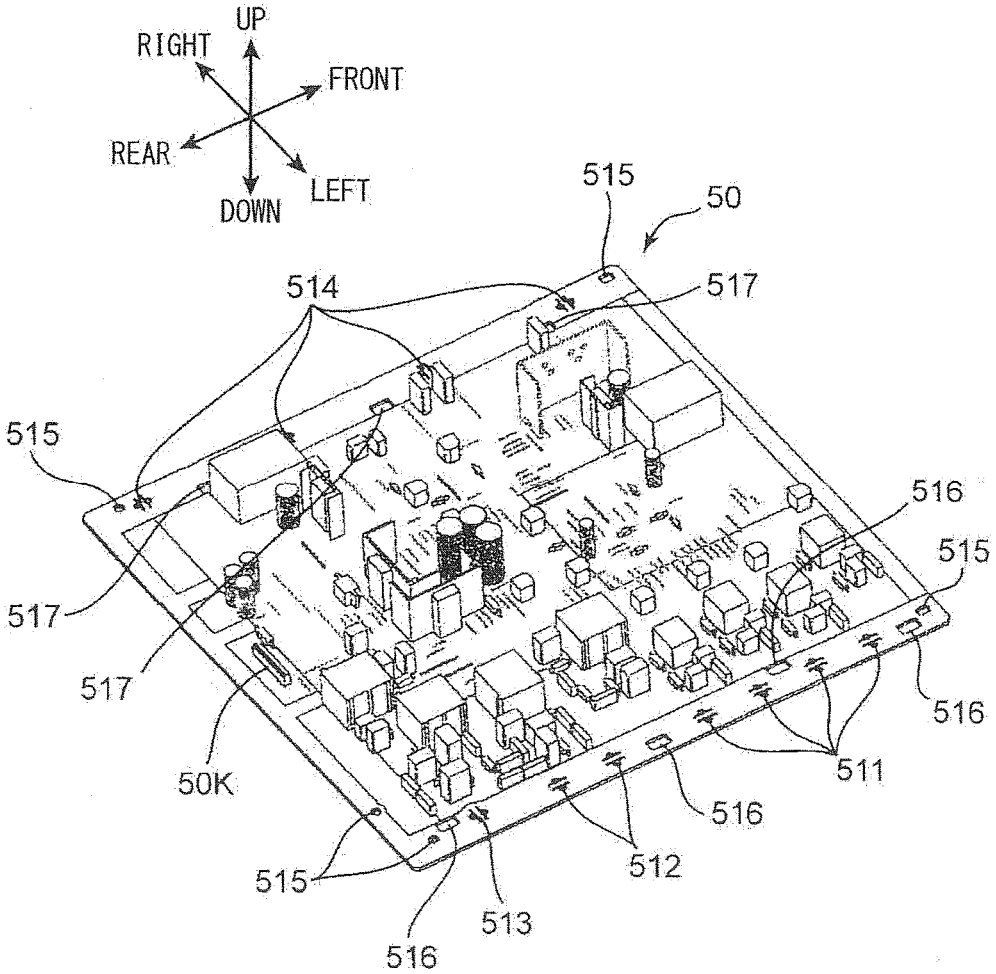
FIG. 6 is a perspective view of the electric board of the image forming apparatus according to the embodiment of the disclosure.

FIG. 5 is a perspective view of the high-voltage board 50 and the image forming unit 10 inside the image forming apparatus 1 according to this embodiment. FIG. 6 is a perspective view of the high-voltage board 50 of the image forming apparatus 1. The high-voltage board 50 is a rectangular-shaped electric board extending in back-and-forth and left-and-right directions. The high-voltage board 50 is placed above the image forming unit 10 in the lower casing 111 so as to extend along the fitting direction of the image forming unit 10. The high-voltage board 50 generates a voltage to be supplied to the image forming unit 10. As shown in FIG. 6, the high-voltage board 50 has a plurality of electric components and output terminals in its upper surface part. More specifically, referring to FIG. 6, the high-voltage board 50 includes first terminals 511 (output terminals), second terminals 512 (output terminals), a third terminal 513 (output terminal), and fourth terminals 514 (output terminals). The first terminals 511 to the fourth terminals 514 function as output terminals in this embodiment. These output terminals are disposed in plurality along the fitting direction of the image forming unit 10 (back-and-forth direction). The first terminals 511 to the fourth terminals 514, which are terminals connected to an unshown power supply circuit in the high-voltage board 50, output various types of voltages to be supplied to the image forming unit 10.

The first terminals 511, the second terminals 512 and the third terminal 513 are disposed in adjacency to one another along a left side portion of the high-voltage board 50. The first terminals 511, which are provided in a quantity of four, output charging biases to be supplied to the charging devices 21 of the individual colors, respectively, of the image forming unit 10. The second terminals 512, which are provided in a quantity of two, output primary transfer biases to be supplied to the primary transfer rollers 24 of the image forming unit 10. It is noted that a bias is supplied from one second terminal 512 to two primary transfer rollers 24. Also, the third terminal 513, which is provided in a quantity of one, outputs a secondary transfer bias to be supplied to the secondary transfer roller 26. Meanwhile, the fourth terminals 514 are disposed in adjacency to one another along a right side portion of the high-voltage board 50. The fourth terminals 514, which are provided in a quantity of four, output developing biases to be supplied to the developing devices 23 of the individual colors in the image forming unit 10.

The high-voltage board 50 also has tightening holes 515, left fixing holes 516, right fixing holes 517, and a connector 50K. The tightening holes 515 are holes opened at four corners of the high-voltage board 50. Unshown screws inserted into the tightening holes 515 are tightened to an unshown frame of the lower casing 111, by which the high-voltage board 50 is fixed to the lower casing 111. The left fixing holes 516 are a plurality of openings opened at back-and-forth intervals in the left side portion of the high-voltage board 50. The right fixing holes 517 are a plurality of openings opened at back-and-forth intervals in the right side portion of the high-voltage board 50. A later-described left interconnecting unit 61 is fitted to the left fixing holes 516, and a later-described right interconnecting unit 62 is fitted to the right fixing holes 517. The connector 50K is a connector placed at a left/right central portion in the rearward side portion of the high-voltage board 50. The connector 50K is provided so as to protrude upward from the upper surface portion of the high-voltage board 50. A cable included in the lower casing 111 is fitted to the connector 50K. Via this cable, transmission and reception of various types of control signals are performed between the high-voltage board 50 and the lower casing 111.

As described above, in this embodiment, various electric components and output terminals are disposed in the upper surface portion of the high-voltage board 50. Therefore, as shown in FIG. 2, only removing the top cover 111T of the lower casing 111 allows the maintenance of the high-voltage board 50 to be easily fulfilled. Meanwhile, in the case where the output terminals of the first terminals 511 to the fourth terminals 514 are placed in the upper surface portion as described above, there arises difficulty in voltage supply to the image forming unit 10 positioned below the high-voltage board 50. Further, the image forming unit 10 is made fittable to and removable from the lower casing 111 in this embodiment. For this reason, there arises a problem that contact failures are more likely to occur in the voltage supply paths. With a view to solving such problems, in this embodiment, the image forming apparatus 1 includes the left interconnecting unit 61 and the right interconnecting unit 62 (both voltage supply units).

Figure 7:
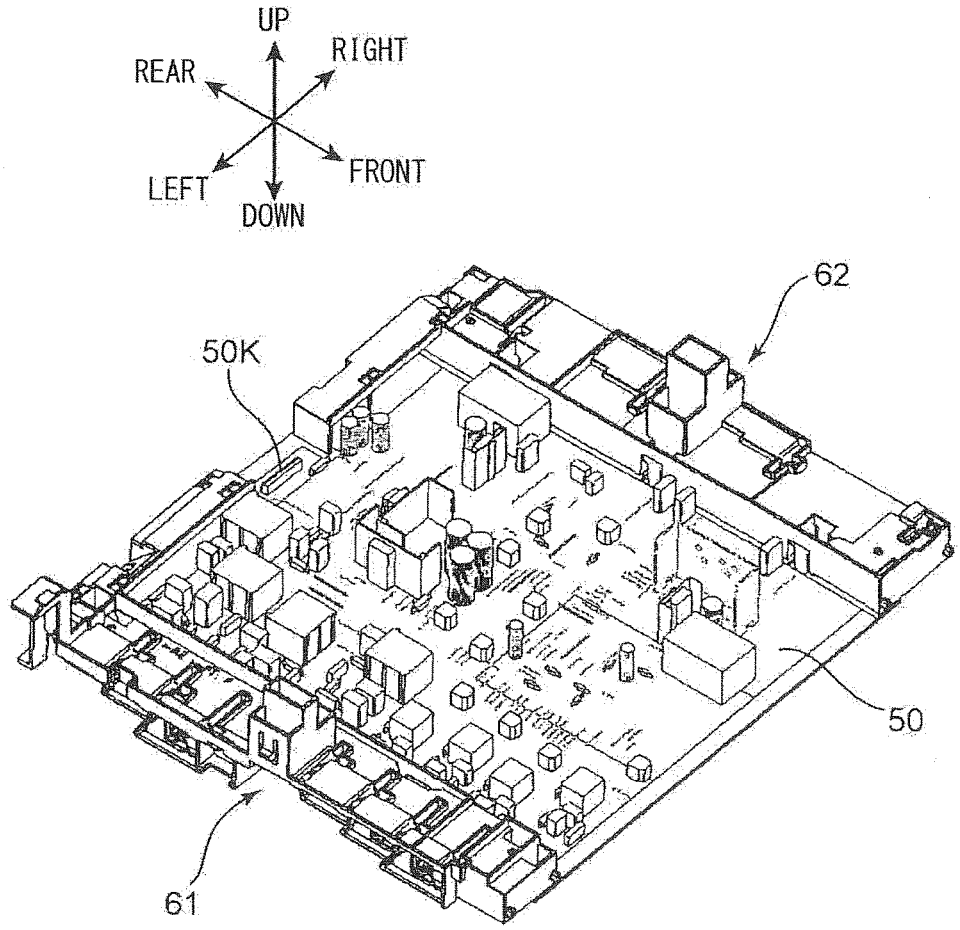
FIG. 7 is a perspective view showing an aspect in which voltage supply units have been fitted to the electric board of the image forming apparatus according to the embodiment of the disclosure.
Figure 8:
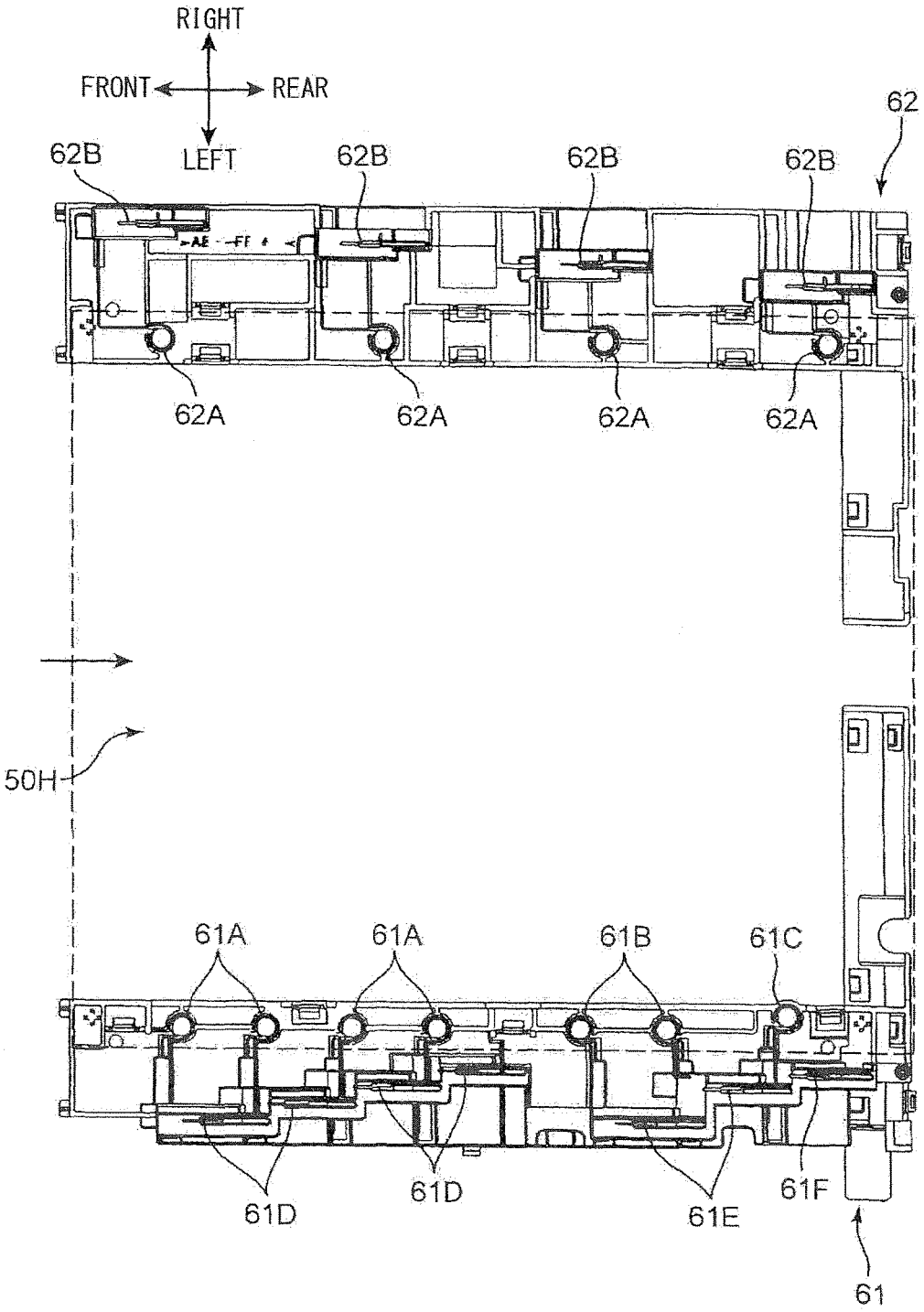
FIG. 8 is a bottom view of the voltage supply units of the image forming apparatus according to the embodiment of the disclosure.
Figure 9:
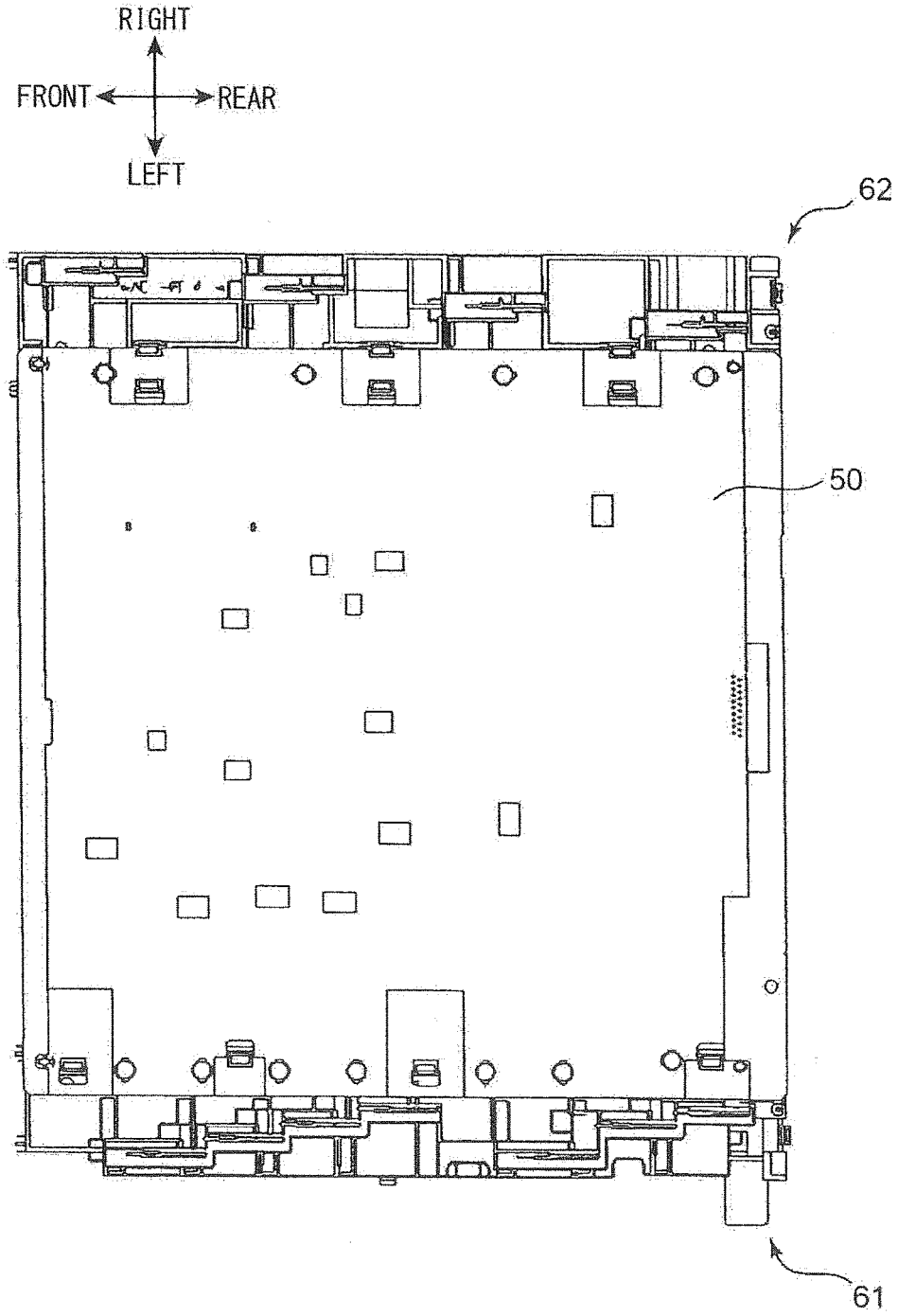
FIG. 9 is a bottom view showing an aspect in which the voltage supply units have been fitted to the electric board of the image forming apparatus according to the embodiment of the disclosure.

FIG. 7 is a perspective view showing an aspect in which the left interconnecting unit 61 and the right interconnecting unit 62 have been fitted to the high-voltage board 50 of the image forming apparatus 1 according to this embodiment. FIG. 8 is a bottom view of the left interconnecting unit 61 and the right interconnecting unit 62. FIG. 9 is a bottom view showing an aspect in which the left interconnecting unit 61 and the right interconnecting unit 62 have been fitted to the high-voltage board 50.

The left interconnecting unit 61 is fitted to a left-side end portion of the high-voltage board 50 extending in the fitting direction of the image forming unit 10. The left interconnecting unit 61 is electrically connected to the first terminals 511, the second terminals 512 and the third terminal 513. Then, the left interconnecting unit 61 supplies voltages to the image forming unit 10 under the high-voltage board 50 via a left side portion of the high-voltage board 50. Similarly, the right interconnecting unit 62 is fitted to a right-side end portion of the high-voltage board 50 extending in the fitting direction of the image forming unit 10. The right interconnecting unit 62 is electrically connected to the fourth terminals 514. Then, the right interconnecting unit 62 supplies voltages to the image forming unit 10 under the high-voltage board 50 via a right side portion of the high-voltage board 50. As shown in FIG. 8, the high-voltage board 50 is placed at a board position 50H formed between the left interconnecting unit 61 and the right interconnecting unit 62 (FIG. 9). As described before, in this embodiment, after the high-voltage board 50 is fixed to the frame of the lower casing 111 with a plurality of screws, the left interconnecting unit 61 and the right interconnecting unit 62 are each fitted to the high-voltage board 50 from above the high-voltage board 50.

Figure 10A:
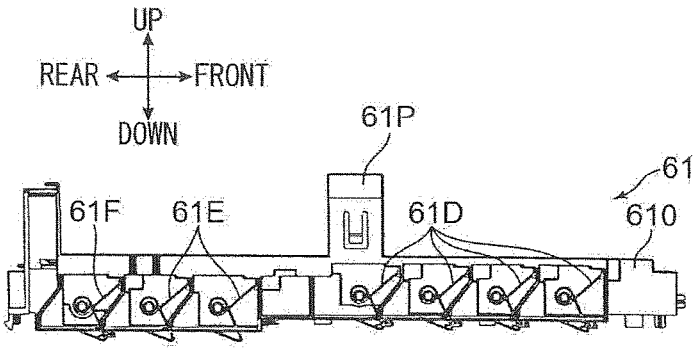
FIG. 10A is a side view of a voltage supply unit according to the embodiment of the disclosure.
Figure 10B:
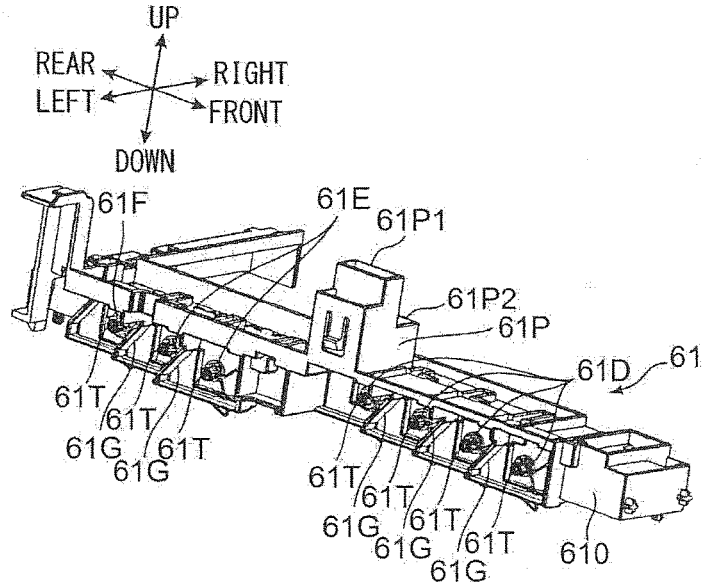
FIG. 10B is a perspective view of the voltage supply unit according to the embodiment of the disclosure.
Figure 10C:
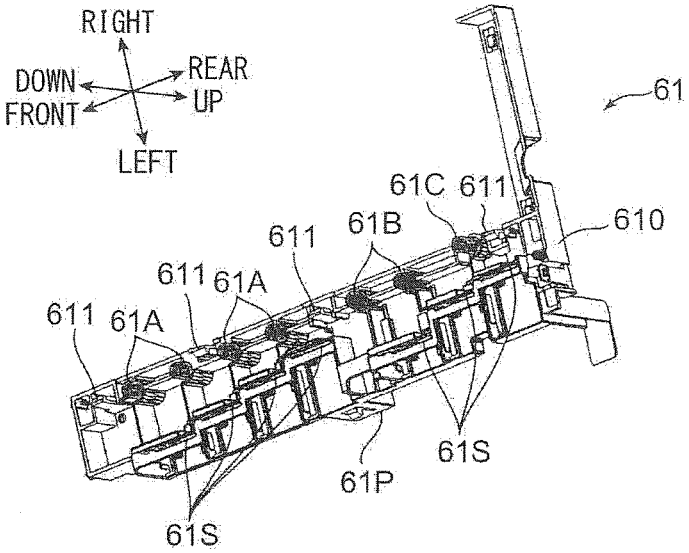
FIG. 10C is a perspective view of the voltage supply unit according to the embodiment of the disclosure.
Figure 11A:
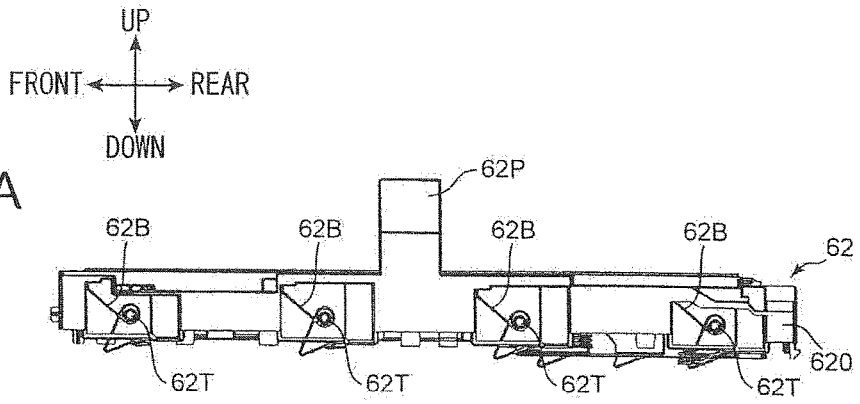
FIG. 11A is a side view of a voltage supply unit according to the embodiment of the disclosure.
Figure 11B:
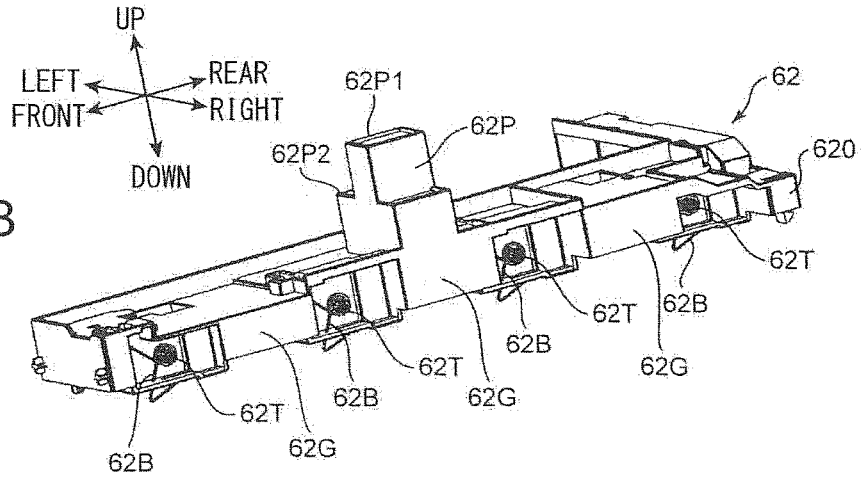
FIG. 11B is a perspective view of the voltage supply unit according to the embodiment of the disclosure.
Figure 11C:
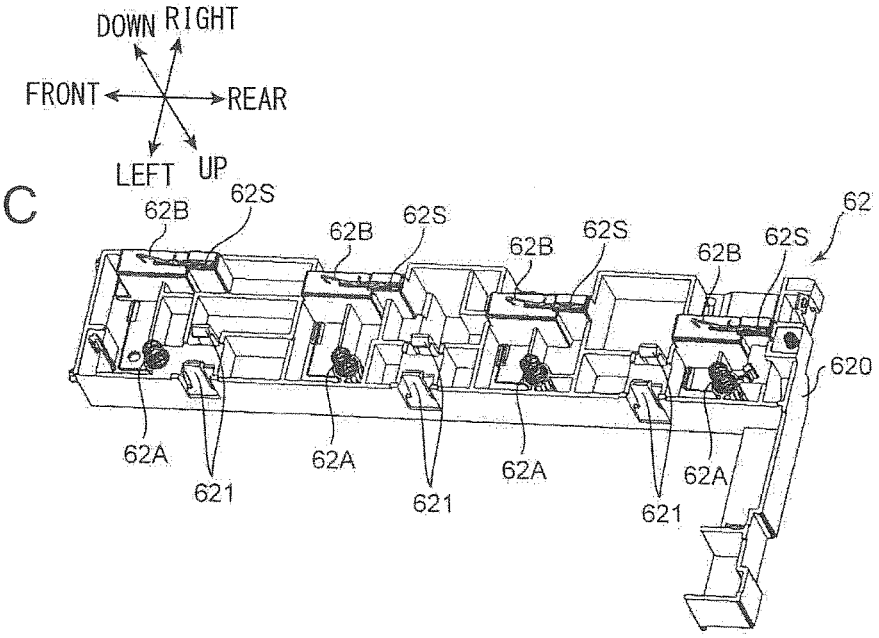
FIG. 11C is a perspective view of the voltage supply unit according to the embodiment of the disclosure.
Figure 12A:
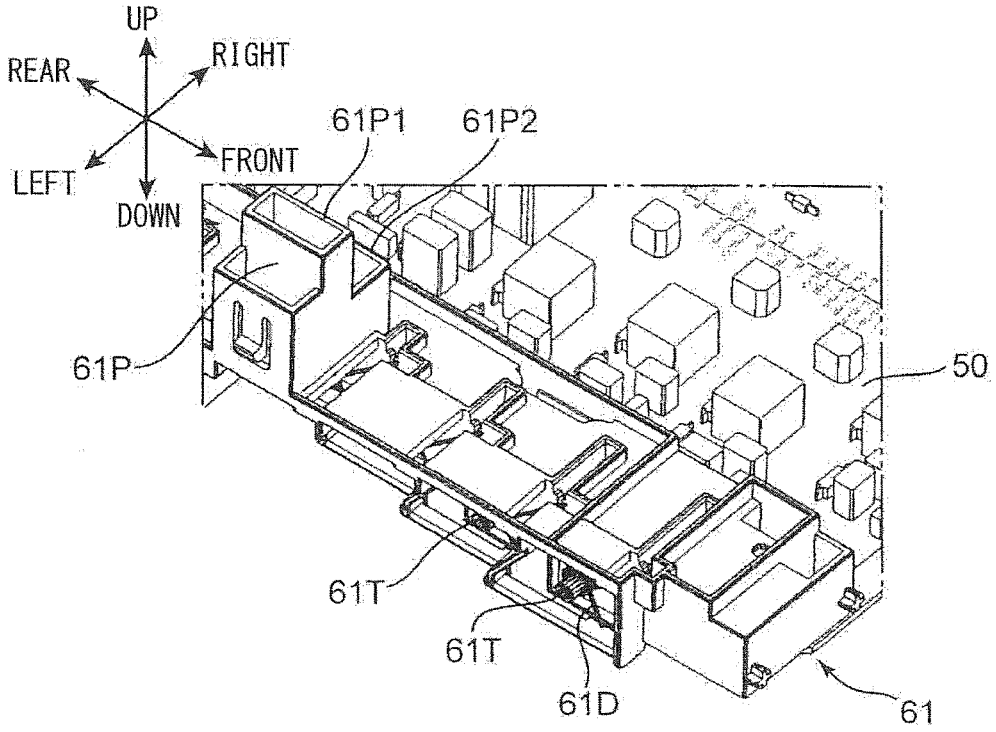
FIG. 12A is an enlarged perspective view of the electric board and the voltage supply unit according to the embodiment of the disclosure.
Figure 12B:
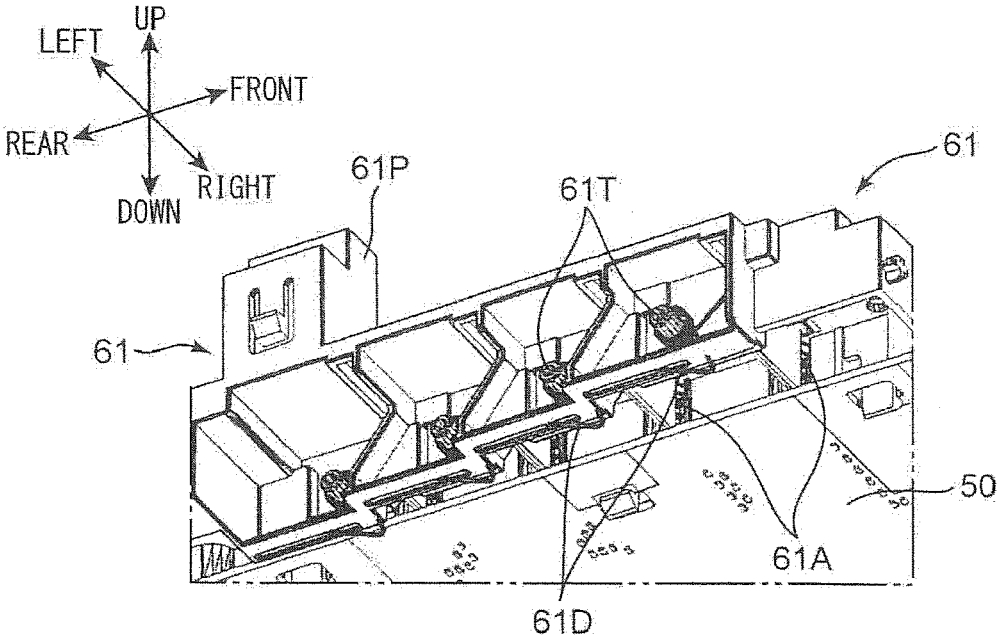
FIG. 12B is an enlarged perspective view of the electric board and the voltage supply unit according to the embodiment of the disclosure.

FIG. 10A is a side view of the left interconnecting unit 61. FIGS. 10B and 10C are perspective views of the left interconnecting unit 61. FIG. 11A is a side view of the right interconnecting unit 62. FIGS. 11B and 11C are perspective views of the right interconnecting unit 62. FIGS. 12A and 12B are enlarged perspective views of the left interconnecting unit 61 according to this embodiment.

The left interconnecting unit 61 is a generally L-shaped unit as viewed from the top (from the bottom). The left interconnecting unit 61 includes a left housing 610 (housing), first compression springs 61A (FIG. 10C) (compression spring member), second compression springs 61B (FIG. 10C) (compression spring member), a third compression spring 61C (FIG. 10C) (compression spring member), first coil springs 61D (coil spring member), second coil springs 61E (coil spring member), and a third coil spring 61F (coil spring member) (FIG. 10B).

The left housing 610 is formed from an insulative resin material so as to have a box-like shape. The left housing 610 holds individual members of the left interconnecting unit 61. The left housing 610 includes left fixing pieces 611 (FIG. 10C), a left protruding portion 61P (pressed portion), left studs 61T (shaft portion) (FIG. 10B), left shield portions 61G (partitioning wall), and left slits 61S (slit) (FIG. 10C).

The left fixing pieces 611 are protruding pieces provided so as to protrude from a lower surface portion of the left housing 610. The left fixing pieces 611 are disposed at back-and-forth intervals. When the left interconnecting unit 61 is fitted to the high-voltage board 50, the left fixing pieces 611 are inserted into the left fixing holes 516 (FIG. 6). The left fixing pieces 611 and the left fixing holes 516 have a known snap-fit structure.

The left protruding portion 61P is a protruding portion which is placed at a back-and-forth central portion of the left housing 610 and which is provided so as to protrude upward from the upper surface portion of the left housing 610. The left protruding portion 61P includes a first pressed portion 61P1 and a second pressed portion 61P2 (FIG. 10B). The first pressed portion 61P1 and the second pressed portion 61P2 form upper surface portions of the left protruding portion 61P. The second pressed portion 61P2 is placed in left/right adjacency to the first pressed portion 61P1 and set lower than the first pressed portion 61P1.

The left studs 61T are shaft portions which are provided so as to protrude from the left side face of the left housing 610. As shown in FIG. 10B, the left studs 61T are provided so as to protrude in directions (widthwise directions) intersecting the fitting direction of the image forming unit 10. Also, the left studs 61T are placed in plurality at back-and-forth intervals.

The left shield portions 61G are wall portions erectly provided between the individual left studs 61T. The left shield portions 61G, which are placed between later-described first coil springs 61D, second coil springs 61E and third coil spring 61F, have a function of preventing leaks (short-circuits).

The left slits 61S (FIG. 10C) are openings opened each in a narrow, back/forth elongated shape in the lower surface portion of the left housing 610. The left slits 61S are placed in plurality at back-and-forth intervals. The plurality of left slits 61S are also placed stepwise at left/right shifted positions.

The first compression springs 61A are electroconductive spring members placed inside the left housing 610. The first compression springs 61A are placed in a quantity of four with intervals from one another on the forward side of the left protruding portion 61P. Upper end portions of the first compression springs 61A are fixed to the upper surface portion of the left housing 610. Meanwhile, lower end portions of the first compression springs 61A are exposed on the lower side of the left housing 610, as shown in FIG. 10C, so as to be electrically connected to the first terminals 511 of the high-voltage board 50.

The second compression springs 61B are electroconductive spring members placed inside the left housing 610. The second compression springs 61B are provided in a quantity of two with an interval therebetween on the backward side of the left protruding portion 61P. Upper end portions of the second compression springs 61B are fixed to the upper surface portion of the left housing 610. Meanwhile, lower end portions of the second compression springs 61B are exposed on the lower side of the left housing 610, as shown in FIG. 10C, so as to be electrically connected to the second terminals 512 of the high-voltage board 50.

Similarly, the third compression spring 61C is an electroconductive spring member placed inside the left housing 610. The third compression spring 61C is provided in a quantity of one on the backward side of the second compression springs 61B. An upper end portion of the third compression spring 61C is fixed to the upper surface portion of the left housing 610. Meanwhile, a lower end portion of the third compression spring 61C is exposed on the lower side of the left housing 610, as shown in FIG. 10C, so as to be electrically connected to the third terminal 513 of the high-voltage board 50.

When the left interconnecting unit 61 is fitted to the high-voltage board 50, the first compression springs 61A, the second compression springs 61B and the third compression spring 61C are compressed between the left housing 610 and the high-voltage board 50.

The first coil springs 61D, the second coil springs 61E and the third coil spring 61F are pivotably supported by the left studs 61T of the left housing 610. The first coil springs 61D, the second coil springs 61E and the third coil spring 61F are electroconductive spring members. The first coil springs 61D are electrically connected to the first compression springs 61A, the second coil springs 61E are electrically connected to the second compression springs 61B, and further the third coil spring 61F is electrically connected to the third compression spring 61C. The first coil springs 61D are provided in a quantity of four in correspondence to the four first compression springs 61A. Similarly, the second coil springs 61E are provided in a quantity of two, and the third coil spring 61F is provided in a quantity of one. Also, the first coil springs 61D, the second coil springs 61E and the third coil spring 61F have a function of supplying voltages to the image forming unit 10.

As shown in FIG. 12B, when the left interconnecting unit 61 is fitted to the high-voltage board 50, the left end side of the lower surface portion of the left interconnecting unit 61 is exposed outside the high-voltage board 50. Also, as shown in FIG. 10A, the first coil springs 61D, the second coil springs 61E and the third coil spring 61F are partly protruded from the left slits 61S (FIG. 10C) downward of the left housing 610.

The right interconnecting unit 62 is a generally L-shaped unit as viewed from the top (from the bottom) as in the case of the left interconnecting unit 61. The right interconnecting unit 62 includes a right housing 620 (housing), fourth compression springs 62A (FIG. 11C) (compression spring member), and fourth coil springs 62B (FIGS. 11A and 11B) (coil spring member).

The right housing 620 is formed from an insulative resin material so as to have a box-like shape. The right housing 620 holds individual members of the right interconnecting unit 62. The right housing 620 includes right fixing pieces 621 (FIG. 11C), a right protruding portion 62P (pressed portion) (FIG. 11B), right studs 62T (shaft portion), right shield portions 62G (partitioning wall), and right slits 62S (slit) (FIG. 11C).

The right fixing pieces 621 are protruding pieces provided so as to protrude from the lower surface portion of the right housing 620. The right fixing pieces 621 are placed in one pair so as to be opposed to each other in the left/right direction, and moreover such pairs of right fixing pieces 621 are placed in plurality at back-and-forth intervals. When the right interconnecting unit 62 is fitted to the high-voltage board 50, one of each paired right fixing pieces 621 is engaged with the right fixing hole 517 (FIG. 6). The other of each paired right fixing pieces 621 is engaged with an end edge of the high-voltage board 50. The right fixing pieces 621 and the right fixing holes 517 have a known snap-fit structure.

The right protruding portion 62P is a protruding portion which is placed at a back-and-forth central portion of the right housing 620 and which is provided so as to protrude upward from the upper surface portion of the right housing 620. The right protruding portion 62P includes a third pressed portion 62P1 and a fourth pressed portion 62P2 (FIG. 11B). The third pressed portion 62P1 and the fourth pressed portion 62P2 form upper surface portions of the right protruding portion 62P. The fourth pressed portion 62P2 is placed in left/right adjacency to the third pressed portion 62P1 and set lower than the third pressed portion 62P1.

The right studs 62T are shaft portions which are provided so as to protrude from the right side face of the right housing 620. As shown in FIG. 11B, the right studs 62T are provided so as to protrude in directions (widthwise directions) intersecting the fitting direction of the image forming unit 10. Also, the right studs 62T are placed in plurality at back-and-forth intervals.

The right shield portions 62G are wall portions erectly provided between the individual right studs 62T. The right shield portions 62G, which are placed between neighboring ones of the fourth coil springs 62B, have a function of preventing leaks (short-circuits). In addition, the right shield portions 62G form the right side face of the right housing 620, and the right studs 62T are placed at recessed portions where the right side face of the right housing 620 is partly recessed leftward.

The right slits 62S (FIG. 11C) are openings opened each in a narrow, back/forth elongated shape in the lower surface portion of the right housing 620. The right slits 62S are placed in plurality at back-and-forth intervals. The plurality of right slits 62S are also placed stepwise at left/right shifted positions.

The fourth compression springs 62A are electroconductive spring members placed inside the right housing 620. The fourth compression springs 62A are placed two by two, each with an interval therebetween, on the forward and backward sides, respectively, of the right protruding portion 62P. Upper end portions of the fourth compression springs 62A are fixed to the upper surface portion of the right housing 620. Meanwhile, lower end portions of the fourth compression springs 62A are exposed on the lower side of the right housing 620, as shown in FIG. 11C, so as to be electrically connected to the fourth terminals 514 (FIG. 6) of the high-voltage board 50. In addition, when the right interconnecting unit 62 is fitted to the high-voltage board 50, the fourth compression springs 62A are compressed between the right housing 620 and the high-voltage board 50.

The fourth coil springs 62B are pivotably supported by the right studs 62T of the right housing 620. The fourth coil springs 62B are electroconductive spring members. The fourth coil springs 62B are electrically connected to the fourth compression springs 62A. For this reason, the fourth coil springs 62B are placed in a quantity of four in correspondence to the four fourth compression springs 62A. Also, the fourth coil springs 62B have a function of supplying voltages to the image forming unit 10.

Figure 13:
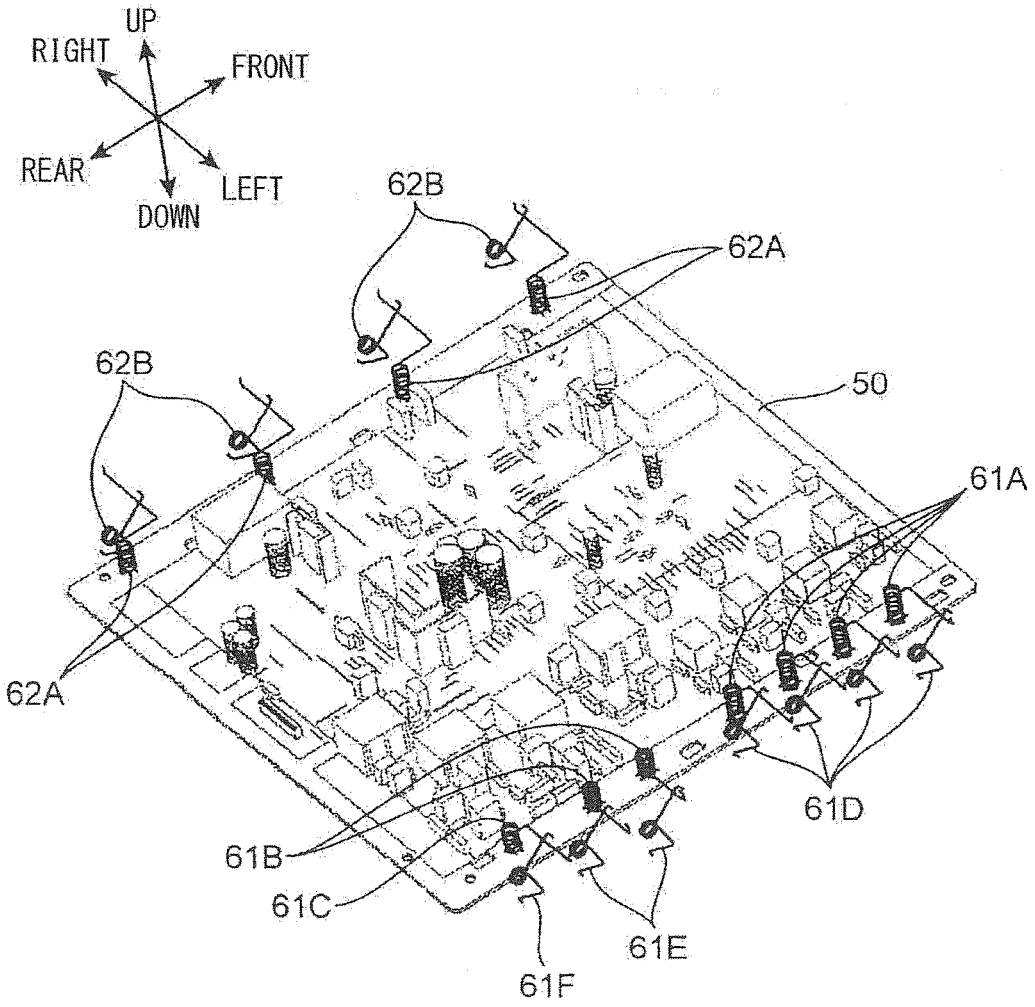
FIG. 13 is a perspective view showing the electric board, compression spring members, and coil spring members according to the embodiment of the disclosure.
Figure 14A:
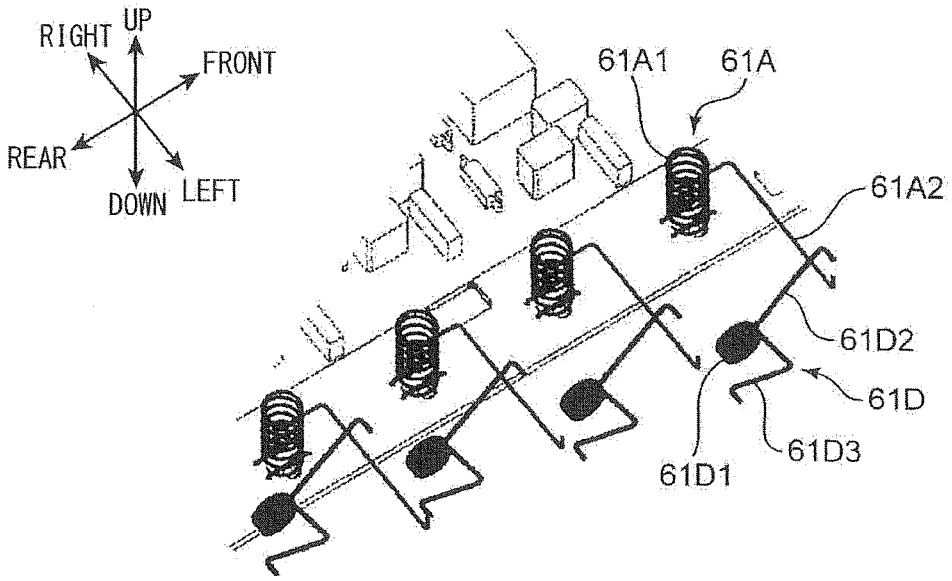
FIG. 14A is an enlarged perspective view of the electric board, the compression spring members, and the coil spring members according to the embodiment of the disclosure.
Figure 14B:
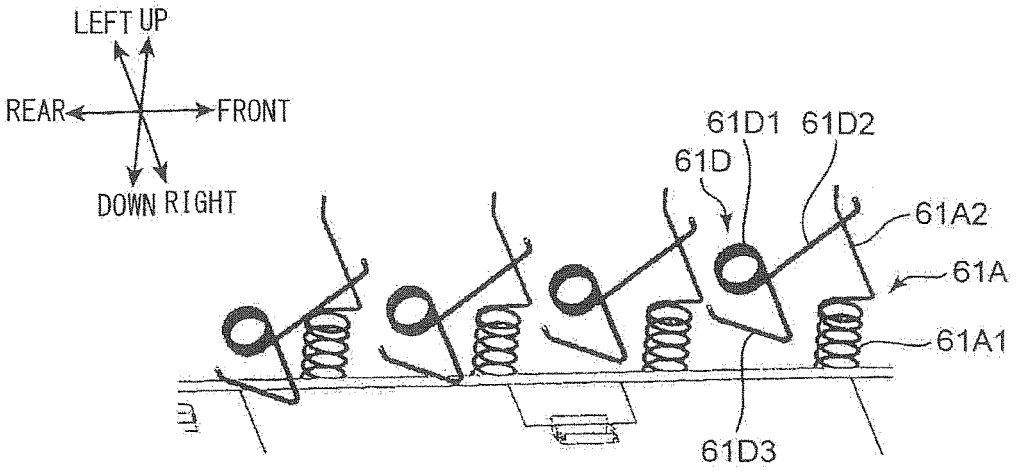
FIG. 14B is an enlarged perspective view of the electric board, the compression spring members, and the coil spring members according to the embodiment of the disclosure.

FIG. 13 is a perspective view showing a placement in which the individual compression spring members and the individual coil spring members are internally fitted to the left interconnecting unit 61 and the right interconnecting unit 62 on the high-voltage board 50 according to this embodiment. FIG. 14A is an enlarged perspective view of part of the high-voltage board 50 of FIG. 13. FIG. 14B is an enlarged perspective view of part of the high-voltage board 50 of FIG. 13 as viewed from below. As shown in FIG. 13, from the high-voltage board 50 having the electric components and the output terminals installed in its upper surface portion, voltages are supplied to the image forming unit 10 via the individual compression spring members and the coil spring members.

Referring to FIG. 14A, each first compression spring 61A includes a compression body portion 61A1 and a first arm portion 61A2. The compression body portion 61A1 is a body portion of the first compression spring 61A and also a spring portion wound in a coil-like shape. A lower end portion of the compression body portion 61A1 is in contact and electrical conduction with the first terminal 511 (FIG. 6). The first arm portion 61A2 is formed by one end of the first compression spring 61A extending from the upper end side of the compression body portion 61A1. The first arm portion 61A2, after extending forward slightly, is bent so as to extend leftward. Further, a forward end portion of the first arm portion 61A2 is bent so as to extend upward slightly. The forward end side of the first arm portion 61A2 is fixed in the left housing 610. In addition, the second compression springs 61B, the third compression spring 61C and the fourth compression springs 62A also have a structure similar to that of the first compression springs 61A.

Referring to FIGS. 14A and 14B, each first coil spring 61D includes a coil body portion 61D1 (pivotal portion), a second arm portion 61D2, and a third arm portion 61D3. The coil body portion 61D1 is a body portion of the first coil spring 61D and also a spring portion wound in a coil-like shape. The coil body portion 61D1 is externally fitted to the left stud 61T so as to be pivotable. The second arm portion 61D2 is one end portion of the first coil spring 61D extending from the coil body portion 61D1. The second arm portion 61D2 extends from the front end side of the coil body portion 61D1 in a radial direction of the pivoting of the first coil spring 61D. More specifically, the second arm portion 61D2, after extending forward and upward, is bent so as to extend leftward slightly. The second arm portion 61D2 is set in contact with the first arm portion 61A2 of the first compression spring 61A. The third arm portion 61D3 is the other end portion of the first coil spring 61D extending from the coil body portion 61D1. The third arm portion 61D3 extends from the rear end side of the coil body portion 61D1 in a direction different from that of the second arm portion 61D2. More specifically, the third arm portion 61D3, after extending forward and downward, is bent in a generally V-like shape so as to extend upward and backward. Further, the forward end portion of the third arm portion 61D3 is bent so as to extend leftward slightly. The V-like portion of the third arm portion 61D3 protrudes downward from the left slit 61S.

Figure 15A:
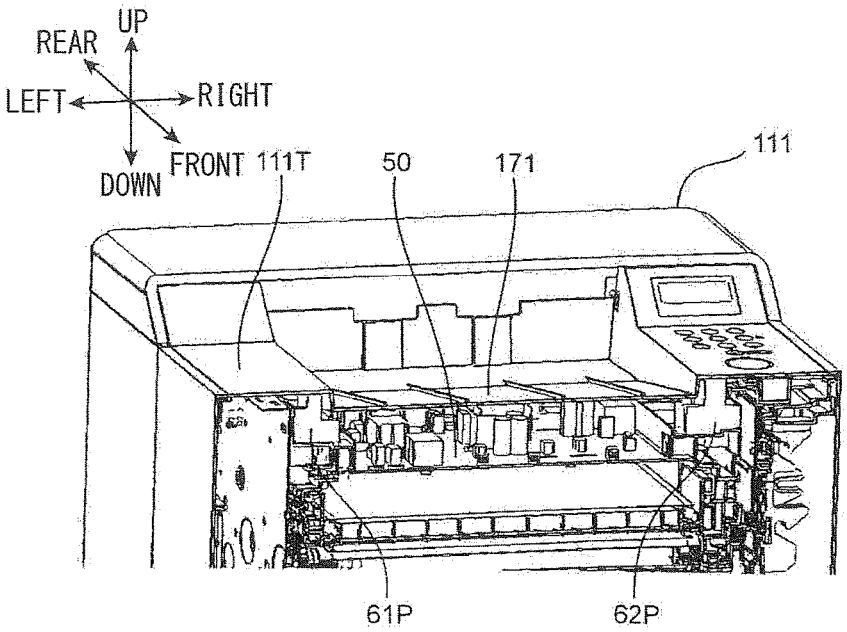
FIG. 15A is a cross-sectional perspective view of an image forming apparatus according to an embodiment of the disclosure.
Figure 15B:
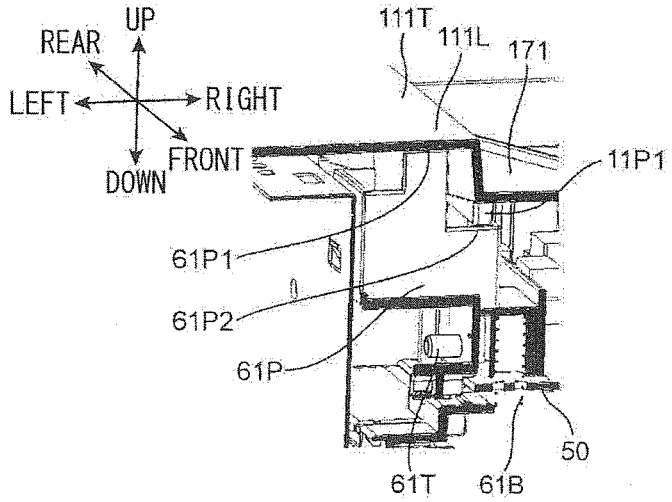
FIG. 15B is an enlarged cross-sectional perspective view of part of the image forming apparatus of FIG. 15A.
Figure 15C:
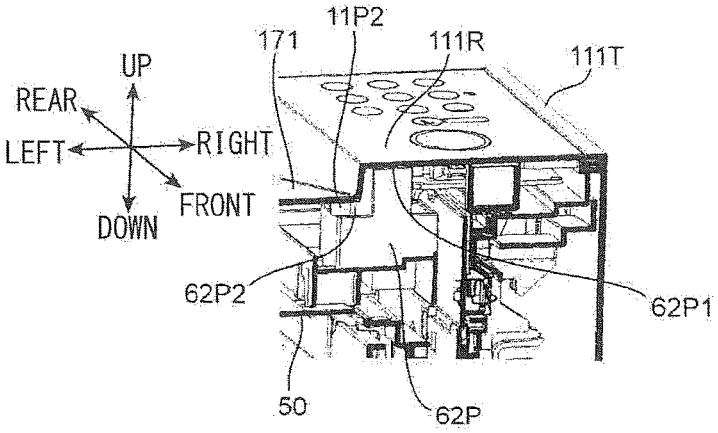
FIG. 15C is an enlarged cross-sectional perspective view of part of the image forming apparatus of FIG. 15A.

FIG. 15A is a cross-sectional perspective view of the image forming apparatus 1 according to this embodiment. FIGS. 15B and 15C are enlarged cross-sectional perspective views of part of the image forming apparatus 1 of FIG. 15A. As described before, the top cover 111T is placed at the upper surface portion of the lower casing 111. Also, the top cover 111T includes the sheet discharge tray 171. Just under the sheet discharge tray 171, the high-voltage board 50 is placed. In the top cover 111T, a left side portion 111L and a right side portion 111R (each side portion) are placed on left and right sides of the sheet discharge tray 171, respectively. The left side portion 111L and the right side portion 111R define the upper surface portion of the lower casing 111. The sheet discharge tray 171 is placed below the left side portion 111L and the right side portion 111R. Also, the top cover 111T includes a first pressing portion 11P1 and a second pressing portion 11P2 (each protruding portion). The first pressing portion 11P1 is a protrusion provided so as to protrude downward from the left end portion of the lower surface portion of the sheet discharge tray 171. Similarly, the second pressing portion 11P2 is a protrusion provided so as to protrude downward from the right end portion of the lower surface portion of the sheet discharge tray 171. The first pressing portion 11P1 and the second pressing portion 11P2 are positioned upward of the second pressed portion 61P2 and the fourth pressed portion 62P2, respectively (FIGS. 15B and 15C). Also, just under the left side portion 111L and the right side portion 111R, the first pressed portion 61P1 and the third pressed portion 62P1 are positioned, respectively. As the top cover 111T is fitted to the lower casing 111, lower surface portions of the left side portion 111L and the right side portion 111R press downwardly the first pressed portion 61P1 and the third pressed portion 62P1, respectively. Also, the first pressing portion 11P1 and the second pressing portion 11P2 placed in the lower surface portion of the sheet discharge tray 171 press download the second pressed portion 61P2 and the fourth pressed portion 62P2, respectively.

Figure 16A:
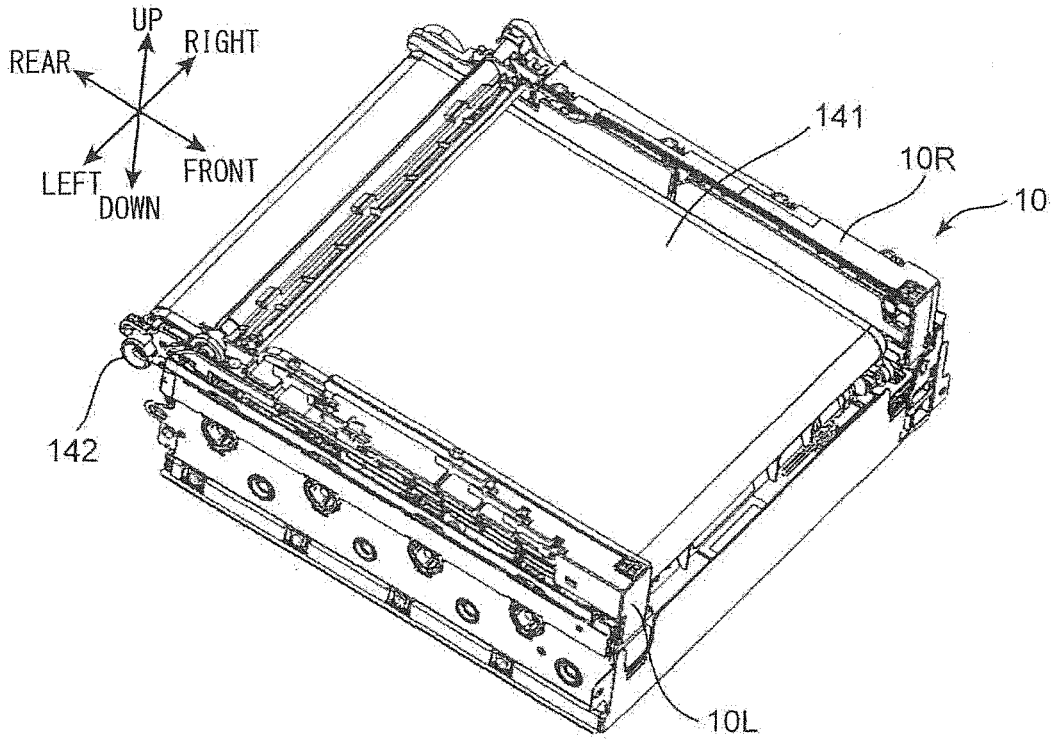
FIG. 16A is a perspective view of the image forming unit according to the embodiment of the disclosure.
Figure 16B:
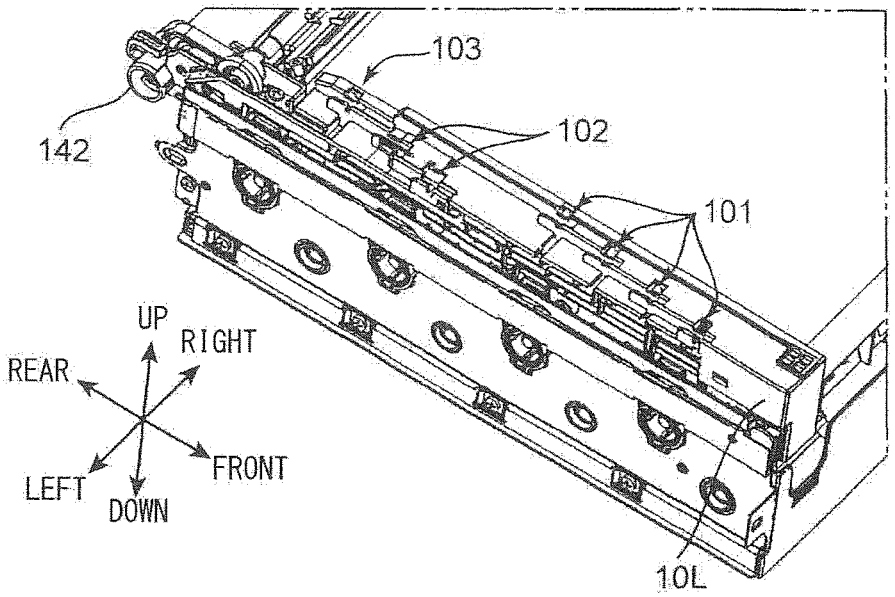
FIG. 16B is an enlarged perspective view of part of the image forming unit of FIG. 16A.
Figure 17A:
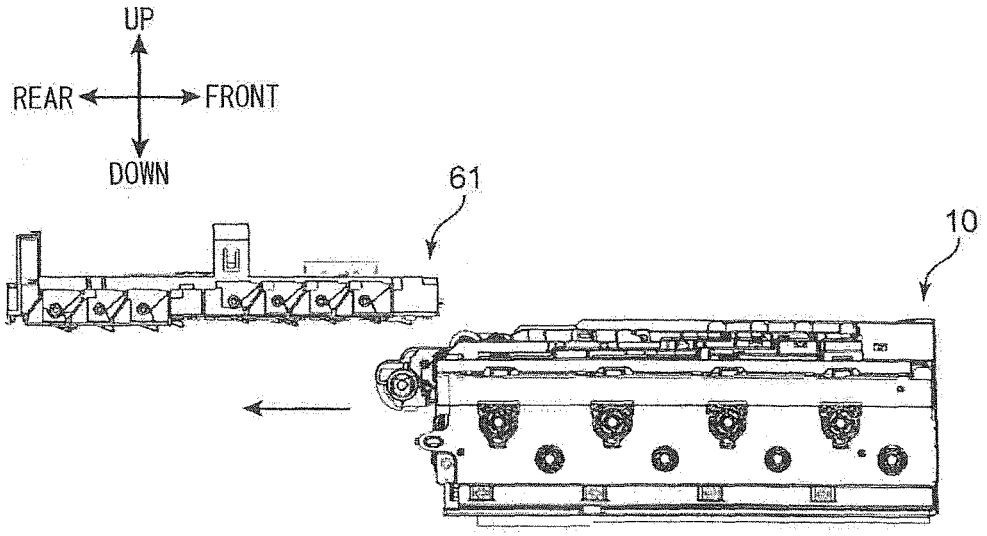
FIG. 17A is a side view showing an aspect in which the image forming unit is inserted inside the image forming apparatus according to the embodiment of the disclosure.
Figure 17B:
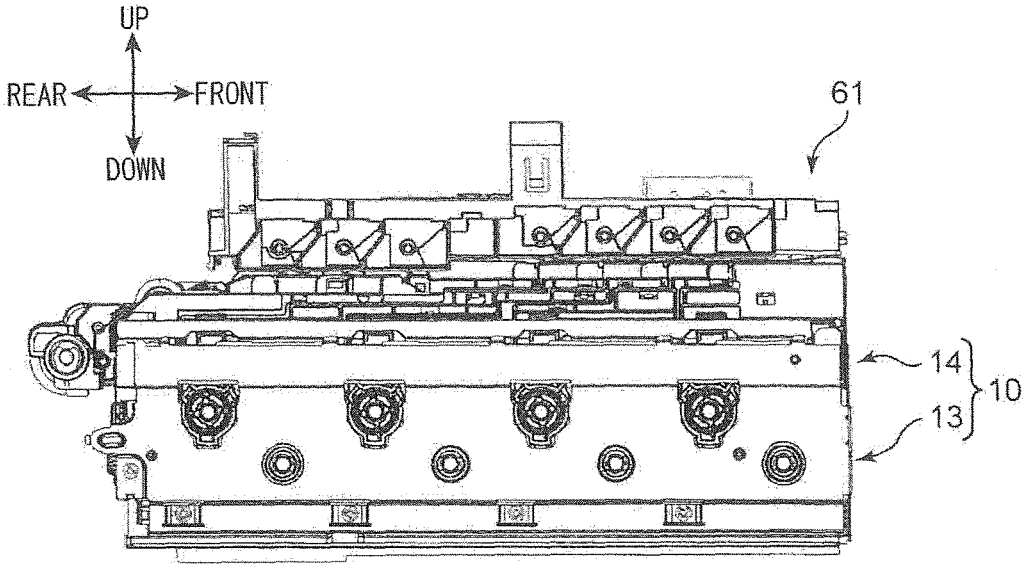
FIG. 17B is a side view showing an aspect in which the image forming unit has been fitted inside the image forming apparatus according to the embodiment of the disclosure.
Figure 18A:
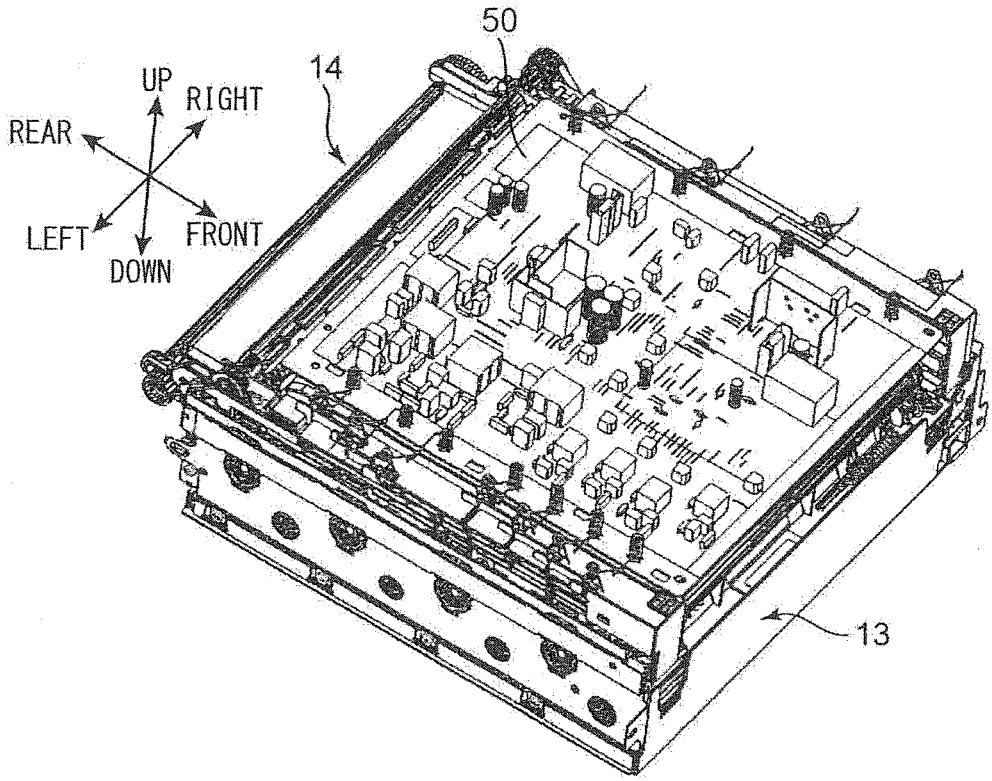
FIG. 18A is a perspective view showing an aspect in which the image forming unit has been fitted inside the image forming apparatus according to the embodiment of the disclosure.
Figure 18B:
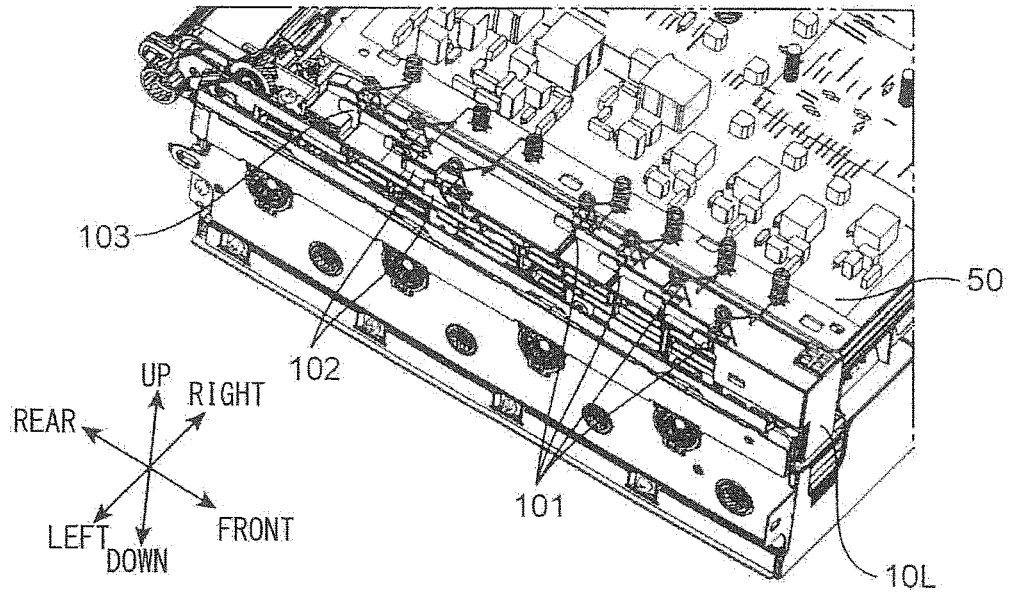
FIG. 18B is an enlarged perspective view showing an aspect in which the image forming unit has been fitted inside the image forming apparatus according to the embodiment of the disclosure.
Figure 19:
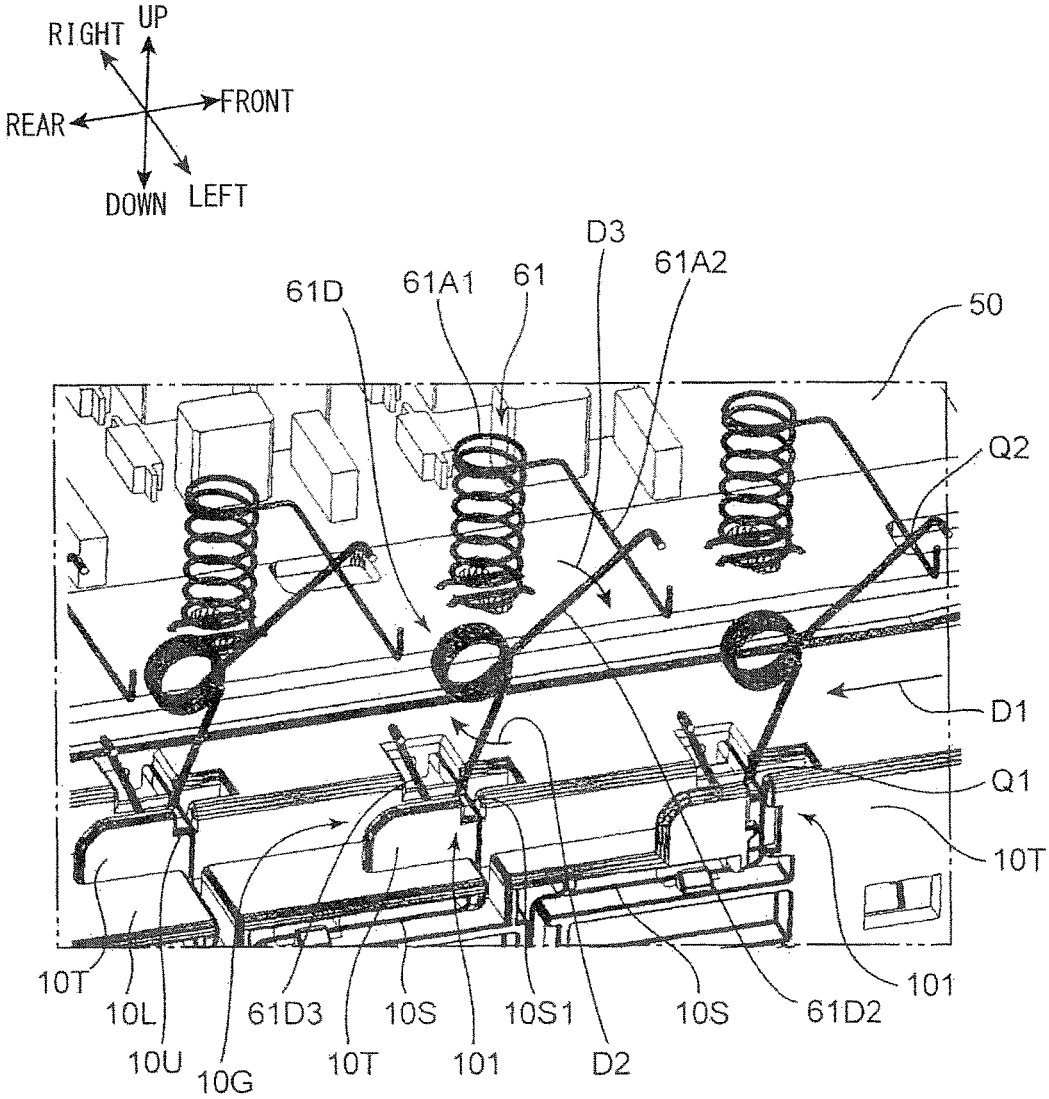
FIG. 19 is a perspective view showing positional relationships among the electric board, the compression spring members, the coil spring members and the image forming unit inside the image forming apparatus according to the embodiment of the disclosure.

FIG. 16A is a perspective view of the image forming unit 10 according to this embodiment. FIG. 16B is an enlarged perspective view of part of the image forming unit 10 of FIG. 16A. FIG. 17A is a side view showing an aspect in which the image forming unit 10 is inserted inside the image forming apparatus 1. Also, FIG. 17B is a side view showing an aspect in which the image forming unit 10 has been fitted inside the image forming apparatus 1. Further, FIG. 18A is a perspective view showing an aspect in which the image forming unit 10 has been fitted inside the image forming apparatus 1. FIG. 18B is an enlarged perspective view of part of FIG. 18A. FIG. 19 is a perspective view showing positional relationships among the high-voltage board 50, individual compression spring members, individual coil spring members, and the image forming unit 10 inside the image forming apparatus 1.

Referring to FIG. 16A, the image forming unit 10 includes a left unit wall portion 10L and a right unit wall portion 10R. The left unit wall portion 10L and the right unit wall portion 10R are wall portions erectly provided on the left and right, respectively, of the image forming unit 10. The individual members in the image forming unit 10 are supported by the left unit wall portion 10L and the right unit wall portion 10R. First contact portions 101, second contact portions 102 and a third contact portion 103 are placed in the upper surface portion of the left unit wall portion 10L. These contact portions each have a contact spring 10S (FIG. 19) (input terminal). The contact spring 10S receives a voltage from the left interconnecting unit 61. The contact springs 10S included in the four first contact portions 101, while abutting on the first coil springs 61D, are electrically connected to the charging devices 21 of the individual colors. Also, the contact springs 10S included in the two second contact portions 102, while abutting on the second coil springs 61E, are branched and thereafter electrically connected to the primary transfer rollers 24 of the individual colors. Further, the contact spring 10S included in the third contact portion 103, while abutting on the third coil spring 61F, is electrically connected to the secondary transfer roller 26. In addition, four contact portions similar to the first contact portions 101, the second contact portions 102 and the third contact portion 103 are placed also in the upper surface portion of the right unit wall portion 10R. The contact springs 10S included in these contact portions, while abutting on the fourth coil springs 62B of the right interconnecting unit 62, are electrically connected to the developing devices 23 of the individual colors.

Furthermore, referring to FIG. 19, a plurality of protruding walls 10T are provided protrusively on the upper surface portion of the left unit wall portion 10L. These protruding walls 10T, varied from one another in their positions in the left/right and back/forth directions, are positioned at successively backward-shifted positions along the insertion direction (arrow D1 in FIG. 19) of the image forming unit 10. Then, guide portions 10G are formed between neighboring ones of the protruding walls 10T. The third arm portion 61D3 of the first coil spring 61D protruded from the left interconnecting unit 61 enters each guide portion 10G. Also, an abutting portion 10S1, which is one end portion of the above-described contact spring 10S, is engaged with a cutout 10U formed in each protruding wall 10T. In this state, the abutting portion 10S1 extends in the left/right direction so as to stretch over between neighboring protruding walls 10T via the guide portion 10G. In addition, the other end portion of the contact spring 10S on the opposite side counter to the abutting portion 10S1 is connected to the individual members in the image forming unit 10.

As shown in FIG. 17A, the image forming unit 10 is inserted along a specified fitting direction (arrow D1 in FIG. 19) to under the left interconnecting unit 61 (right interconnecting unit 62) in the image forming apparatus 1. In this case, the third arm portions 61D3 corresponding to the individual colors enter the guide portions 10G. Then, as the abutting portion 10S1 of each contact spring 10S has abutted on the third arm portion 61D3, the abutting portion 10S1 presses the third arm portion 61D3 in the fitting direction (arrow D2 in FIG. 19). Then, the first coil spring 61D is pivoted around the left stud 61T (FIG. 10B) so that the second arm portion 61D2 presses the first arm portion 61A2 of the first compression spring 61A (arrow D3 in FIG. 19). As a result, as electric contacts, a first contacting portion Q1 and a second contacting portion Q2 are formed, by which the high-voltage board 50, the left interconnecting unit 61 and the image forming unit 10 are brought into conduction with one another. In addition, voltage paths supplied from the second terminals 512, the third terminal 513 and the fourth terminals 514, which have already been described, are also formed in the same manner as described above.

In this embodiment, as described above, voltages are supplied from the first terminals 511 (FIG. 6) provided in the upper surface portion of the high-voltage board 50, via the left interconnecting unit 61, to the image forming unit 10 placed below the high-voltage board 50. As a result, a stable bias supply to the fittable-and-removable image forming unit 10 is fulfilled. Also, a stable bias supply to the image forming unit 10 is fulfilled by the electroconductive first compression springs 61A and first coil springs 61D. In particular, by utilizing elastic force of the first compression springs 61A and the first coil springs 61D, enough contact pressure of the electric contacts can be ensured. As a result, contact failures at the electric contacts are suppressed. Further, a plurality of electric contacts (first contacting portion Q1, second contacting portion Q2) are formed stably by pivoting of the first coil springs 61D entailed by insertion of the image forming unit 10.

Referring to FIG. 19, when the abutting portion 10S1 presses the third arm portion 61D3 in the fitting direction, pressing force is imparted from the coil body portion 61D1 of the first coil spring 61D (FIG. 14A), via the left stud 61T (FIG. 10B), upward to the left housing 610 of the left interconnecting unit 61. In this case, floating of the left housing 610 could cause decreases in the contact pressure or contact failures at the contacts between the first compression springs 61A and the first coil springs 61D (second contacting portions Q2) or the contacts between the first compression springs 61A and the first terminals 511. In order to solve such problems, in this embodiment, the top cover 111T presses the left interconnecting unit 61 downward. Therefore, the left interconnecting unit 61 is prevented from floating upward upon fitting of the image forming unit 10. As a result of this, contact failures at a plurality of electric contacts are prevented. In addition, an abutting place between the top cover 111T and the left interconnecting unit 61 is positioned at a back-and-forth central portion of the left interconnecting unit 61. Therefore, occurrence of contact failures due to not only the fitting of the image forming unit 10 but also flexure of the left housing 610 of the left interconnecting unit 61 or the like is suppressed. Also, the left side portion 111L of the top cover 111T presses the first pressed portion 61P1 of the left protruding portion 61P while the first pressing portion 11P1 protruding from the sheet discharge tray 171 presses the second pressed portion 61P2, so that pressed places of different heights are formed. As a result, a stable fixation of the left interconnecting unit 61 can be achieved. Furthermore, since the pressure with which the second pressed portion 61P2 is pressed by the top cover 111T is increased by the protrusive-shaped left protruding portion 61P, upward floating of the left interconnecting unit 61 is further suppressed. In addition, similar effects are produced also with the top cover 111T and the right interconnecting unit 62.

Also in this embodiment, the first terminals 511 of the high-voltage board 50 are placed in plurality along the fitting direction of the image forming unit 10. Also, the first compression springs 61A and the first coil springs 61D of the left interconnecting unit 61 are placed in plurality along the fitting direction in correspondence to the plurality of first terminals 511. Further, the contact springs 10S of the image forming unit 10 are placed in plurality along the filling direction in correspondence to the plurality of first coil springs 61D. In addition to this, the plurality of first coil springs 61D are placed at different positions in the widthwise (left/right) direction of the image forming unit 10, while the plurality of contact springs 10S are placed at widthwise different positions in correspondence to the positions of the third arm portions 61D3 with which the contact springs come into contact, respectively. Therefore, interference among the plurality of voltage supply paths upon insertion of the image forming unit 10 is prevented.

Further in this embodiment, the left housing 610 of the left interconnecting unit 61 is formed from a resin material. Therefore, the left interconnecting unit 61 is made up with low cost. Also, by the use of an insulative resin material for the left housing 610, short-circuits in the left interconnecting unit 61 is prevented. In particular, the left housing 610 includes the left shield portions 61G. Therefore, along-plane distances among the plurality of voltage supply paths are enlarged, so that short-circuits in the left interconnecting unit 61 are further prevented. Similar effects are produced also with the right shield portions 62G of the right interconnecting unit 62.

Although the image forming apparatus 1 according to one embodiment of this disclosure has been described in detail hereinabove, yet the disclosure is not limited to this. This disclosure may be carried out, for example, in such modified embodiments as described below.

(1) The above embodiment has been described in a mode in which the image forming unit 10 includes the image forming part 13 and the intermediate transfer unit 14. However, the disclosure is not limited to this. The unit that is made fittable and removable to the casing 11 may be a unit forming part of the image forming part 13 or may be the intermediate transfer unit 14 alone.

(2) The above embodiment has been described in a mode in which the left interconnecting unit 61 and the right interconnecting unit 62 are fitted to the high-voltage board 50. However, the disclosure is not limited to this. The disclosure may be carried out in a mode in which either one of the left interconnecting unit 61 and the right interconnecting unit 62 is fitted to the high-voltage board 50.

As described above, the image forming apparatus 1 according to this embodiment includes: an apparatus body 111 having a fittable-and-removable top plate 111T; an image forming unit 10 which is fittable and removable to the apparatus body 111 along a specified fitting direction and which forms a developer image; a transfer part 26 for transferring the developer image onto a sheet; an electric board 50 which is placed in the apparatus body 111 so as to extend in the fitting direction above the image forming unit 10 and which has a plurality of electric components and an output terminal (511 to 514) in its upper surface portion to generate a voltage to be supplied to the image forming unit 10, the electric board being to be exposed outside the apparatus body 111 when the top plate 111T is removed from the apparatus body 111; and a voltage supply unit (61, 62) which is fitted to a side end portion of the electric board 50 extending in the fitting direction and electrically connected to the output terminal (511 to 514) to supply the voltage to the image forming unit 10 via a side portion of the electric board 50.

With this constitution, when the top plate 111T is removed from the apparatus body 111, the electric board 50 is exposed outside the apparatus body 111. Therefore, access to the electric board 50 is facilitated, allowing the maintenance of the electric board 50 to be efficiently achieved. Further, the voltage is supplied from the output terminal (511 to 514) provided in the upper surface portion of the electric board 50, via the voltage supply unit (61, 62), to the image forming unit 10 placed below the electric board 50. As a result, a stable bias supply to the fittable-and-removable image forming unit 10 can be fulfilled.

In the above-described constitution, desirably, the voltage supply unit (61, 62) includes: a housing (610, 620); an electroconductive compression spring member (61A to 61C, 62A) which is placed so as to be compressed between the housing (610, 620) and the electric board 50 and which is electrically connected to the output terminal (511 to 514); and an electroconductive coil spring member (61D to 61F, 62B) which is supported by the housing (610, 620) and which is electrically connected to the compression spring member (61A to 61C, 62A) to supply the voltage to the image forming unit 10. With this constitution, a stable bias supply to the image forming unit 10 is fulfilled by the electroconductive compression spring member (61A to 61C, 62A) and the coil spring member (61D to 61F, 62B). In particular, enough contact pressure of the electric contact can be ensured by utilizing elastic force of the spring member. As a result, contact failures at the electric contact are suppressed.

In the above-described constitution, desirably, the housing (610, 620) of the voltage supply unit (61, 62) is fitted to the electric board 50 from above the electric board 50, the housing including: a shaft portion (61T, 62T) provided so as to protrude in a widthwise direction intersecting the fitting direction; and a slit (61S, 62S) opened along the fitting direction in a lower surface portion of the housing (610, 620), the compression spring member (61A to 61C, 62A) has a lower end portion set in contact with the output terminal (511 to 514) and an upper end portion set in contact with the housing (610, 620), the compression spring member thereby being compressively deformed and the compression spring member further including a first arm portion 61A2 extending in the widthwise direction, the coil spring member (61D to 61F, 62B) includes: a coil-like pivotal portion 61D1 which is externally fitted to the shaft portion (61T, 62T) so as to be pivotable; a second arm portion 61D2 which extends from the pivotal portion 61D1 in a radial direction of the pivoting so as to be set in contact with the first arm portion 61A2; and a third arm portion 61D3 which extends from the pivotal portion 61D1 in a direction different from that of the second arm portion 61D2 so as to protrude downward from the slit (61S, 62S), the image forming unit 10 includes an input terminal 10S for receiving the voltage from the voltage supply unit (61, 62), and wherein when the image forming unit 10 is inserted into the apparatus body 111, the input terminal 10S presses the third arm portion 61D3 in the fitting direction so that the coil spring member (61D to 61F, 62B) is pivoted around the shaft portion (61T, 62T), causing the second arm portion 61D2 to press the first arm portion 61A2, whereby the electric board 50, the voltage supply unit (61, 62) and the image forming unit 10 are brought into conduction with one another. With this constitution, a stable formation of a plurality of electric contacts (Q1, Q2) is achieved by pivoting of the coil spring members (61D to 61F, 62B) entailed by the insertion of the image forming unit 10.

In the above-described constitution, desirably, the housing (610, 620) is formed from a resin material. With this constitution, the voltage supply unit (61, 62) is made up with low cost. Also, by the use of an insulative resin material, short-circuits in the voltage supply unit are prevented.

In the above-described constitution, desirably, the output terminal (511 to 514) of the electric board 50 is placed in plurality along the fitting direction, the compression spring member (61A to 61C, 62A) and the coil spring member (61D to 61F, 62B) of the voltage supply unit (61, 62) are placed each in plurality along the fitting direction in correspondence to the plurality of output terminals (511 to 514), and the housing (610, 620) includes a partitioning wall 61G for partitioning neighboring ones of the compression spring members (61A to 61C, 62A) or neighboring ones of the coil spring members (61D to 61F, 62B) from each other. With this constitution, along-plane distances among the plurality of voltage supply paths are enlarged, so that short-circuits in the voltage supply units (61, 62) are further prevented.

In the above-described constitution, desirably, the output terminal (511 to 514) of the electric board 50 is placed in plurality along the fitting direction, the compression spring member (61A to 61C, 62A) and the coil spring member (61D to 61F, 62B) of the voltage supply unit (61, 62) are placed each in plurality along the fitting direction in correspondence to the plurality of output terminals (511 to 514), the input terminal 10S of the image forming unit 10 is placed in plurality along the fitting direction in correspondence to the plurality of coil spring members (61D to 61F, 62B), the plurality of coil spring members (61D to 61F, 62B) are placed at widthwise different positions, and the plurality of input terminals 10S are placed at widthwise different positions in correspondence to the positions of the third arm portions 61D3 with which the input terminals come into contact, respectively. With this constitution, interference among a plurality of voltage supply paths upon the fitting of the image forming unit 10 is prevented.

In the above-described constitution, desirably, when the image forming unit 10 is inserted into the apparatus body 111, the input terminal 10S presses the third arm portion 61D3 in the fitting direction so that pressing force is imparted upward to the housing (610, 620), and the housing (610, 620) includes a pressed portion (61P, 62P) placed in the upper surface portion, and when the top plate 111T is fitted to the apparatus body 111, the top plate 111T presses downward the pressed portion (61P, 62P). With this constitution, upward floating of the voltage supply unit (61, 62) upon the fitting of the image forming unit 10 is suppressed. As a result, contact failures at the plurality of electric contacts (Q1, Q2) are prevented.

In the above-described constitution, desirably, the pressed portion (61P, 62P) is placed at a central portion in the fitting direction of the housing (610, 620). With this constitution, upward floating of the voltage supply unit (61, 62) upon the fitting of the image forming unit 10 is further suppressed.

In the above-described constitution, desirably, the pressed portion (61P, 62P) includes a first pressed portion 61P1, and a second pressed portion 61P2 placed in widthwise-neighboring adjacency to the first pressed portion 61P1 and set lower than the first pressed portion 61P1, and the top plate 111T includes a side portion (111L, 111R) for defining the upper surface portion of the apparatus body 111, and a sheet discharge part 171 which is placed below the side portion and to which a sheet with an image formed thereon is to be discharged, and when the top plate 111T is fitted to the apparatus body 111, a lower surface portion of the side portion (111L, 111R) presses the first pressed portion 61P1 and a lower surface portion of the sheet discharge part 171 presses the second pressed portion 61P2. With this constitution, upward floating of the voltage supply unit (61, 62) upon the fitting of the image forming unit 10 is further suppressed.

In the above-described constitution, desirably, the top plate 111T includes a protruding portion 11P1 which is provided so as to protrude downward from the lower surface portion of the sheet discharge part 171 and which presses the second pressed portion 61P2. With this constitution, pressure with which the second pressed portion 61P2 is pressed by the top cover 111T is increased, so that upward floating of the voltage supply unit (61, 62) upon the fitting of the image forming unit 10 is further suppressed.

The voltage supply method of this disclosure is a voltage supply method for the image forming apparatus 1 of the above-described constitution, in which a voltage is supplied from the output terminal (511 to 514) provided in the upper surface portion of the electric board 50, via the voltage supply unit (61, 62), to the image forming unit 10 placed below the electric board 50. With this arrangement, a stable bias supply to the fittable-and-removable image forming unit 10 can be fulfilled.

According to this disclosure, there can be provided an image forming apparatus and a voltage supply method by which a stable bias supply to the fittable-and-removable image forming unit is fulfilled and moreover the accessibility to the board is improved.

What is claimed is:

1. An image forming apparatus comprising:

an apparatus body having a fittable-and-removable top plate;

an image forming unit which is fittable and removable to the apparatus body along a specified fitting direction and which forms a developer image;

a transfer part for transferring the developer image onto a sheet;

an electric board which is placed in the apparatus body so as to extend in the fitting direction above the image forming unit and which has a plurality of electric components and an output terminal in its upper surface portion to generate a voltage to be supplied to the image forming unit, the electric board being exposed outside the apparatus body when the top plate is removed from the apparatus body;

a first voltage supply unit which is fitted to one side end portion of the electric board extending in the fitting direction and electrically connected to the output terminal provided to one side of the electric board to supply the voltage to the image forming unit via a side portion of the electric board; and a second voltage supply unit which is fitted to another side end portion of the electric board extending in the fitting direction and electrically connected to the output terminal provided to another side of the electric board to supply the voltage to the image forming unit from the electric board, wherein the image forming unit includes:

a plurality of image forming parts which are arranged next to each other along the fitting direction and which form developer images;

an intermediate transfer unit which transfers the developer images to the sheet; and input terminals for receiving the voltages from the first and second voltage supply units, the input terminals are arranged at different positions in a widthwise direction intersecting the fitting direction, the first and second voltage supply units each comprises:

a housing;

an electroconductive compression spring member which is placed so as to be compressed between the housing and the electric board and which is electrically connected to the output terminal; and an electroconductive coil spring member which is supported by the housing and which is electrically connected to the compression spring member to supply the voltage to the image forming unit.

2. The image forming apparatus according to claim 1, wherein the housing of the first and second voltage supply units is fitted to the electric board from above the electric board, the housing including: a shaft portion provided so as to protrude in a the widthwise direction; and a slit opened along the fitting direction in a lower surface portion of the housing, the compression spring member has a lower end portion set in contact with the output terminal and an upper end portion set in contact with the housing, the compression spring member thereby being compressively deformed and the compression spring member further including a first arm portion extending in the widthwise direction, the coil spring member includes:

a coil-like pivotal portion which is externally fitted to the shaft portion so as to be pivotable;

a second arm portion which extends from the pivotal portion in a radial direction of the pivoting so as to be set in contact with the first arm portion; and a third arm portion which extends from the pivotal portion in a direction different from that of the second arm portion so as to protrude downward from the slit, and when the image forming unit is inserted into the apparatus body, the input terminal presses the third arm portion in the fitting direction so that the coil spring member is pivoted around the shaft portion, causing the second arm portion to press the first arm portion, whereby the electric board, the first and second voltage supply units and the image forming unit are brought into conduction with one another.

3. The image forming apparatus according to claim 2, wherein the housing is formed from a resin material.

4. The image forming apparatus according to claim 3, wherein the output terminal of the electric board is placed in plurality along the fitting direction, the compression spring member and the coil spring member of the first and second voltage supply units are placed each in plurality along the fitting direction in correspondence to the plurality of output terminals, and the housing includes a partitioning wall for partitioning neighboring ones of the compression spring members or neighboring ones of the coil spring members from each other.

5. The image forming apparatus according to claim 2, wherein the output terminal of the electric board is placed in plurality along the fitting direction, the compression spring member and the coil spring member of the first and second voltage supply units are placed each in plurality along the fitting direction in correspondence to the plurality of output terminals, the input terminal of the image forming unit is placed in plurality along the fitting direction in correspondence to the plurality of coil spring members, the plurality of coil spring members are placed at widthwise different positions, and the plurality of input terminals are placed at widthwise different positions in correspondence to the positions of the third arm portions with which the input terminals come into contact, respectively.

6. The image forming apparatus according to claim 2, wherein when the image forming unit is inserted into the apparatus body, the input terminal presses the third arm portion in the fitting direction so that pressing force is imparted upward to the housing, and wherein the housing includes a pressed portion placed in the upper surface portion, and when the top plate is fitted to the apparatus body, the top plate presses downward the pressed portion.

7. The image forming apparatus according to claim 6, wherein the pressed portion is placed at a central portion in the fitting direction of the housing.

8. The image forming apparatus according to claim 6, wherein the pressed portion includes a first pressed portion, and a second pressed portion placed in widthwise-neighboring adjacency to the first pressed portion and set lower than the first pressed portion, and the top plate includes a side portion for defining the upper surface portion of the apparatus body, and a sheet discharge part which is placed below the side portion and to which a sheet with an image formed thereon is to be discharged, and wherein when the top plate is fitted to the apparatus body, a lower surface portion of the side portion presses the first pressed portion and a lower surface portion of the sheet discharge part presses the second pressed portion.

9. The image forming apparatus according to claim 8, wherein the top plate includes a protruding portion which is provided so as to protrude downward from the lower surface portion of the sheet discharge part and which presses the second pressed portion.

10. The image forming apparatus according to claim 6, wherein the pressed portion is placed at a central portion in the fitting direction of the housing, the pressed portion including: a first pressed portion; and a second pressed portion which is placed in widthwise-neighboring adjacency to the first pressed portion and which is set lower than the first pressed portion, and wherein the top plate includes:

a side portion for defining the upper surface portion of the apparatus body; and a sheet discharge part which is placed below the side portion and to which a sheet with an image formed thereon is to be discharged, and wherein when the top plate is fitted to the apparatus body, a lower surface portion of the side portion presses the first pressed portion and a lower surface portion of the sheet discharge part presses the second pressed portion, and the top plate includes a protruding portion which is provided so as to protrude downward from the lower surface portion of the sheet discharge part and which presses the second pressed portion.

11. A voltage supply method for an image forming apparatus having an apparatus body, an image forming unit, a transfer part, an electric board, a first voltage supply unit, and a second voltage supply unit, wherein the apparatus body includes a fittable-and-removable top plate, the first and second voltage supply units each comprises:

a housing;

an electroconductive compression spring member which is placed so as to be compressed between the housing and the electric board and which is electrically connected to the output terminal; and an electroconductive coil spring member which is supported by the housing and which is electrically connected to the compression spring member to supply the voltage to the image forming unit, the image forming unit includes:

a plurality of image forming parts which are arranged next to each other along the fitting direction and which form developer images;

an intermediate transfer unit which transfers the developer images to the sheet; and input terminals for receiving the voltages from the first and second voltage supply units, the input terminals are arranged at different positions in a widthwise direction intersecting the fitting direction, the image forming unit is made fittable and removable to the apparatus body along a specified fitting direction and forms a developer image, the transfer part transfers the developer image onto a sheet, the electric board is placed in the apparatus body so as to extend in the fitting direction above the image forming unit and has a plurality of electric components and an output terminal in its upper surface portion, the electric board being exposed outside the apparatus body when the top plate is removed from the apparatus body, and the first voltage supply unit is fitted to one side end portion of the electric board extending in the fitting direction and electrically connected to the output terminal to supply the voltage to the image forming unit from a side portion of the electric board, whereby the second voltage supply unit is fitted to another side end portion of the electric board extending in the fitting direction and electrically connected to the output terminal provided to another side of the electric board to supply the voltage to the image forming unit from the electric board, and when the image forming unit is inserted in the apparatus body, the input terminals of the image forming unit make electrical contact with the first or second voltage supply unit, and the voltage is supplied from the output terminal provided in the upper surface portion of the electric board, from the first and second voltage supply units, to the image forming unit placed below the electric board.

12. An image forming apparatus comprising:

an apparatus body having a fittable-and-removable top plate;

an image forming unit which is fittable and removable to the apparatus body along a specified fitting direction and which forms a developer image;

a transfer part for transferring the developer image onto a sheet;

an electric board which is placed in the apparatus body so as to extend in the fitting direction above the image forming unit and which has a plurality of electric components and an output terminal in its upper surface portion to generate a voltage to be supplied to the image forming unit, the electric board being to be exposed outside the apparatus body when the top plate is removed from the apparatus body;

a first voltage supply unit which is fitted to one side end portion of the electric board extending in the fitting direction and electrically connected to the output terminal provided to one side of the electric board to supply the voltage to the image forming unit via a side portion of the electric board; and a second voltage supply unit which is fitted to another side end portion of the electric board extending in the fitting direction and electrically connected to the output terminal provided to another side of the electric board to supply the voltage to the image forming unit from the electric board, wherein the image forming unit includes:

a plurality of image forming parts which are arranged next to each other along the fitting direction and which include photosensitive drums, charging devices, and developing devices to form developer images on the photosensitive drums;

an intermediate transfer unit which includes an intermediate transfer belt and a primary transfer roller to transfer the developer images to the intermediate transfer belt;

a plurality of first input terminals for receiving from the first voltage supply unit the voltage to be fed to the charging devices and the primary transfer roller; and a plurality of second input terminals for receiving from the second voltage supply unit the voltage to be fed to the developing devices, the plurality of first and second input terminals are each arranged at different positions in a widthwise direction intersecting the fitting direction, when the image forming unit is inserted in the apparatus body, the first input terminals of the image forming unit make electrical contact with the first voltage supply unit, the second input terminals of the image forming unit make electrical contact with the second voltage supply unit, and the voltage is supplied to the image forming unit from the electric board via the first and second input terminals.

* * * * *